US010096309B2

(12) United States Patent
Suitor

(10) Patent No.: US 10,096,309 B2
(45) **Date of Patent: *Oct. 9, 2018**

(54) MAGNETICALLY SECURED INSTRUMENT TRIGGER

(71) Applicant: Rare Earth Dynamics, Inc., Radcliff, KY (US)

(72) Inventor: Stephen Riley Suitor, Radcliff, KY (US)

(73) Assignee: Rare Earth Dynamics, Inc., Radcliff, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/702,713

(22) Filed: Sep. 12, 2017

(65) Prior Publication Data

US 2018/0005619 A1 Jan. 4, 2018

Related U.S. Application Data

(63) Continuation-in-part of application No. 14/988,570, filed on Jan. 5, 2016, now Pat. No. 9,761,212.

(60) Provisional application No. 62/259,047, filed on Nov. 23, 2015, provisional application No. 62/100,041, filed on Jan. 5, 2015, provisional application No. 62/448,388, filed on Apr. 21, 2017, provisional application No. 62/448,953, filed on Apr. 24, 2017.

(51) Int. Cl.

| | |
|---|---|
| ***G10H 3/14*** | (2006.01) |
| ***G10H 3/18*** | (2006.01) |
| ***G10D 13/02*** | (2006.01) |

(52) U.S. Cl.

CPC ..... *G10H 3/143* (2013.01); *G10D 13/024* (2013.01); *G10H 3/146* (2013.01); *G10H 3/183* (2013.01); *G10H 3/186* (2013.01); *G10H 2220/525* (2013.01); *G10H 2230/305* (2013.01)

(58) Field of Classification Search

CPC ..... G10D 13/024; G10H 3/143; G10H 3/146; G10H 3/18; G10H 3/183; G10H 3/186; G10H 2220/525; G10H 2230/305

USPC ..... 84/730

See application file for complete search history.

(56) References Cited

U.S. PATENT DOCUMENTS

| | | | |
|---|---|---|---|
| 1,176,943 | A | 9/1913 | Bollinger |
| 1,915,858 | A | 6/1933 | Miessner |
| 2,239,985 | A | 4/1941 | Benioff |
| 2,293,372 | A | 8/1942 | Vasilach |
| 2,655,071 | A | 10/1953 | Levay |
| 2,666,848 | A | 1/1954 | Goodwin |

(Continued)

FOREIGN PATENT DOCUMENTS

| | | |
|---|---|---|
| EP | 0264782 | 4/1988 |
| EP | 2437253 | 4/2012 |

(Continued)

*Primary Examiner* — Jeffrey Donels

(74) *Attorney, Agent, or Firm* — Duncan Galloway Egan Greenwald, PLLC; Kevin T. Duncan

(57) ABSTRACT

An apparatus, system, and method for a magnetically and releasably attachable trigger for an instrument is provided. The trigger and securing device are disposed on either side of a drumhead or other instrument surface via magnetic force, keeping the instrument surface intact and not deforming the instrument surface. Additionally, the trigger provides for an increased sensitivity of sound by being in direct physical contact with the surface on which it is attached.

19 Claims, 30 Drawing Sheets

(56) References Cited

U.S. PATENT DOCUMENTS 2,808,522 A 10/1957 Dranetz
3,053,949 A 9/1962 Johnson
3,170,076 A 2/1965 Thomas
3,198,872 A 8/1965 Finkenbeiner
3,375,747 A 4/1968 Posey
3,439,568 A 4/1969 Griffith
3,453,920 A 7/1969 Scherer
3,509,264 A 4/1970 Green
3,510,566 A 5/1970 McKenzie
3,553,339 A 1/1971 Dominguez et al.
3,634,595 A 1/1972 Pasquali
3,659,032 A 4/1972 May
3,665,490 A 5/1972 Oskar
3,677,126 A 7/1972 Pierce
3,680,423 A 8/1972 Lander
3,725,561 A * 4/1973 Paul ..... G10H 3/146 381/118
3,731,022 A 5/1973 Loftus
3,733,425 A 5/1973 Chaki
3,748,367 A 7/1973 Lamme et al.
3,956,958 A 5/1976 Nash et al.
3,956,959 A 5/1976 Ebihara
4,030,396 A 6/1977 Mariner
4,141,273 A 2/1979 Austin
4,168,646 A 9/1979 May
4,178,823 A 12/1979 McCoskey
4,184,399 A 1/1980 Zuniga
4,189,969 A 2/1980 Katayama et al.
4,200,025 A 4/1980 Currier
4,201,107 A 5/1980 Barber, Jr.
4,226,156 A 10/1980 Hyakutake
4,227,049 A 10/1980 Thomson et al.
4,242,937 A 1/1981 Pozar
4,245,539 A 1/1981 Jones
4,279,188 A 7/1981 Scott
4,290,331 A 9/1981 Izdebski
4,341,140 A 7/1982 Ishida
4,368,400 A 1/1983 Taniguchi et al.
4,371,804 A 2/1983 Peng et al.
4,378,721 A 4/1983 Kaneko et al.
4,415,181 A 11/1983 Hartry et al.
4,418,598 A 12/1983 Ulynas
4,479,412 A 10/1984 Klynas
4,491,050 A 1/1985 Franzmann
4,562,740 A 1/1986 Webber et al.
4,567,805 A 2/1986 Clevinger
4,570,522 A 2/1986 May
4,581,972 A 4/1986 Hoshino
4,581,973 A 4/1986 Hoshino
4,630,465 A 12/1986 Hatton
4,648,302 A 3/1987 Bozzio
4,657,114 A 4/1987 Shaw
4,660,410 A 4/1987 Asano et al.
4,669,349 A 6/1987 Hyakutake
4,672,839 A 6/1987 Takeuchi et al.
4,700,602 A 10/1987 Bozzio
4,737,676 A 4/1988 Engel et al.
4,744,279 A 5/1988 Livingston
4,750,397 A 6/1988 Ashworth-Jones
4,753,146 A 6/1988 Seiler
4,776,253 A 10/1988 Downes
4,809,337 A 2/1989 Scholz et al.
4,817,485 A 4/1989 Bozzio et al.
4,819,536 A 4/1989 Lombardi
4,837,836 A 6/1989 Barcus
4,860,625 A 8/1989 Mathews
4,867,027 A 9/1989 Barbera
4,867,028 A 9/1989 Jones
4,899,633 A 2/1990 Lombardi
4,909,117 A 3/1990 Reiling et al.
4,947,725 A 8/1990 Nomura
4,984,498 A 1/1991 Fishman
5,001,959 A 3/1991 Kimpara
5,042,356 A 8/1991 Karch
5,056,403 A 10/1991 Yamashita
5,063,821 A 11/1991 Battle
5,085,119 A 2/1992 Cole
D324,687 S 3/1992 Olson
5,095,799 A 3/1992 Wallace et al.
5,105,710 A 4/1992 Rothmel
5,105,711 A 4/1992 Barnard
5,115,706 A 5/1992 Aluisi
5,121,668 A 6/1992 Segan
5,123,325 A 6/1992 Turner
5,134,920 A * 8/1992 Clark ..... G10H 3/146 84/477 R
5,140,887 A 8/1992 Chapman
5,142,961 A 9/1992 Paroutaud
5,157,213 A 10/1992 Kashio
5,168,117 A 12/1992 Anderson
5,204,487 A 4/1993 Turner
5,223,658 A 6/1993 Suzuki
5,235,891 A 8/1993 Klein
5,293,000 A 3/1994 Adinolfi
5,315,060 A 5/1994 Paroutaud
5,322,969 A 6/1994 Aaroe et al.
5,345,037 A 9/1994 Nordelius
5,371,830 A 12/1994 Wachenheim
5,401,900 A 3/1995 Lace
5,403,972 A 4/1995 Valentine, Sr.
5,430,245 A 7/1995 Rogers
5,449,964 A * 9/1995 Snyder ..... G10H 1/0556 310/327
5,455,381 A 10/1995 Juszkiewicz et al.
5,463,185 A 10/1995 Fishman
5,484,958 A 1/1996 Ogawa
5,499,541 A 3/1996 Hopf et al.
5,550,321 A 8/1996 Brann
5,583,307 A 12/1996 Tobia, Jr.
5,602,353 A 2/1997 Juszkiewicz et al.
5,602,354 A 2/1997 Martin
5,614,688 A 3/1997 Donnell
5,627,336 A 5/1997 Stevens
5,637,823 A 6/1997 Dodge
5,723,805 A 3/1998 Lacombe
5,744,744 A 4/1998 Wakuda
5,796,025 A 8/1998 Haake
5,811,709 A * 9/1998 Adinolfi ..... G10D 13/024 84/723
5,817,966 A 10/1998 Fishman
5,866,829 A 2/1999 Pecoraro
5,866,836 A 2/1999 Bergstrom
5,878,359 A 3/1999 Takeda
5,900,573 A 5/1999 Barnes
5,934,629 A 8/1999 Peritz
5,977,473 A 11/1999 Adinolfi
6,031,176 A 2/2000 Tanaka
6,075,198 A 6/2000 Grant et al.
6,094,490 A 7/2000 Kim
6,121,528 A 9/2000 May
6,166,307 A 12/2000 Caulkins et al.
6,215,055 B1 4/2001 Saravis
6,369,308 B1 4/2002 Orr
6,441,293 B1 8/2002 LaBarbera
6,723,911 B2 4/2004 Muramatsu et al.
6,794,569 B2 9/2004 Kamijima et al.
D497,935 S * 11/2004 Kamijima ..... D17/22
6,888,057 B2 5/2005 Juszkiewicz et al.
6,979,770 B2 12/2005 Hampton, Jr.
6,982,376 B2 1/2006 Wise
7,015,391 B2 3/2006 Tomoda
7,038,117 B2 5/2006 Yoshino
7,105,731 B1 9/2006 Riedl
7,115,805 B1 10/2006 Vandervoort
7,179,985 B2 2/2007 Pickens
7,259,317 B2 8/2007 Hsien
7,282,633 B1 10/2007 Coolidge
7,323,632 B2 1/2008 Wachter
7,396,991 B2 7/2008 Susami
7,470,847 B2 12/2008 Kitagawa
7,488,887 B2 2/2009 Mori
7,525,032 B2 4/2009 Mishima
7,608,776 B2 10/2009 Ludwig
7,667,130 B2 2/2010 Mishima

(56) References Cited

U.S. PATENT DOCUMENTS

| | | | | |
|---|---|---|---|---|
| 7,723,592 | B1 | 5/2010 | Dixson | |
| 7,754,956 | B2 | 7/2010 | Gain et al. | |
| 8,039,724 | B1 | 10/2011 | Normam et al. | |
| 8,121,300 | B1 | 2/2012 | LoDuca et al. | |
| 8,173,886 | B2 | 5/2012 | Hashimoto | |
| 8,178,768 | B1 | 5/2012 | Shepherd | |
| 8,258,392 | B2 | 9/2012 | Mori | |
| 8,354,581 | B2 | 1/2013 | Eventoff et al. | |
| 8,373,052 | B2 | 2/2013 | Yoshino | |
| 8,410,348 | B1 | 4/2013 | Hsieh | |
| 8,461,446 | B1 | 6/2013 | Gibson | |
| 8,546,676 | B2 | 10/2013 | Hashimoto | |
| 8,563,843 | B1 | 10/2013 | Shemesh | |
| 8,729,378 | B2 | 5/2014 | Ryan | |
| 8,884,151 | B1 | 11/2014 | Lee | |
| 8,916,763 | B2 | 12/2014 | Tetsuro | |
| 9,761,212 | B2 * | 9/2017 | Suitor | G10H 3/18 |
| 9,761,215 | B2 | 9/2017 | Sutton | |
| 2002/0056357 | A1 | 5/2002 | Kassabian | |
| 2002/0056358 | A1 | 5/2002 | Ludwig | |
| 2002/0152872 | A1 | 10/2002 | O'Donnell | |
| 2003/0004603 | A1 | 1/2003 | Hagemeister et al. | |
| 2003/0131721 | A1 | 7/2003 | Minakuchi et al. | |
| 2003/0161493 | A1 * | 8/2003 | Hosier | G10H 3/146 381/353 |
| 2004/0025663 | A1 | 2/2004 | Harada et al. | |
| 2004/0134332 | A1 * | 7/2004 | Kamijima | G10H 3/146 84/411 R |
| 2004/0149120 | A1 | 8/2004 | Maruhashi et al. | |
| 2004/0211310 | A1 | 10/2004 | Hagiwara | |
| 2005/0016367 | A1 | 1/2005 | Hasenmaier | |
| 2005/0022655 | A1 | 2/2005 | Wise | |
| 2005/0087019 | A1 | 4/2005 | Face | |
| 2005/0150366 | A1 | 7/2005 | Susami | |
| 2006/0000341 | A1 | 1/2006 | Steele | |
| 2006/0021495 | A1 | 2/2006 | Freitas | |
| 2006/0219092 | A1 | 10/2006 | Mishima | |
| 2007/0107587 | A1 | 5/2007 | Lee | |
| 2007/0234888 | A1 | 10/2007 | de Moraes | |
| 2008/0034946 | A1 | 2/2008 | Aimi | |
| 2008/0071958 | A1 | 3/2008 | Honda et al. | |
| 2009/0000464 | A1 | 1/2009 | Mishima | |
| 2010/0031800 | A1 | 2/2010 | Van Ekstrom | |
| 2011/0116634 | A1 * | 5/2011 | Norman | H04L 9/3247 380/277 |
| 2012/0060669 | A1 | 3/2012 | Ryan et al. | |
| 2012/0073425 | A1 | 3/2012 | Hashimoto | |
| 2012/0118130 | A1 | 5/2012 | Field | |
| 2012/0180621 | A1 | 7/2012 | Holl | |
| 2013/0098227 | A1 | 4/2013 | Wei | |
| 2013/0112068 | A1 | 5/2013 | Rogers | |
| 2013/0125735 | A1 | 5/2013 | Mori | |
| 2013/0333545 | A1 * | 12/2013 | Dunwoodie | G10H 3/181 84/726 |
| 2014/0000445 | A1 | 1/2014 | Gulak | |
| 2014/0053713 | A1 | 2/2014 | Truchses | |
| 2014/0208926 | A1 * | 7/2014 | Shepherd | G10D 13/021 84/730 |
| 2015/0009417 | A1 | 1/2015 | Jargiello, III | |
| 2015/0068392 | A1 | 3/2015 | Huston et al. | |
| 2015/0143979 | A1 | 5/2015 | Field | |
| 2015/0262567 | A1 * | 9/2015 | Truchsess | G10H 1/32 84/725 |
| 2016/0210941 | A1 | 7/2016 | Suitor | |
| 2016/0247492 | A1 | 8/2016 | Field | |

FOREIGN PATENT DOCUMENTS

| | | |
|---|---|---|
| GB | 2183076 | 6/1986 |
| JP | H03146385 | 6/1991 |
| JP | 11-173876 | 7/1999 |
| JP | 2007-211513 | 8/2007 |
| JP | 2007211513 | 8/2007 |
| JP | 3146385 | 10/2008 |
| JP | 2009-93199 | 4/2009 |
| WO | 1990/003639 | 4/1990 |

* cited by examiner

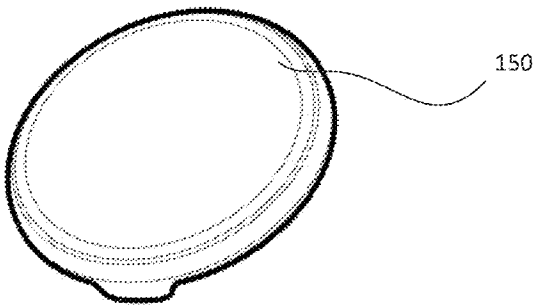
Fig 17
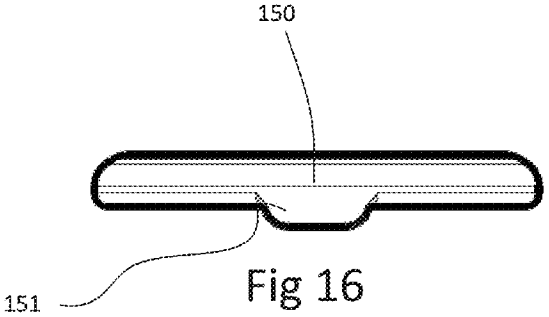
Fig 16
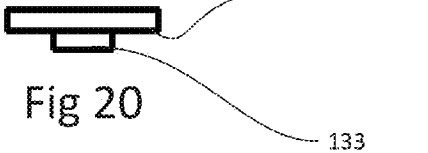
Fig 20
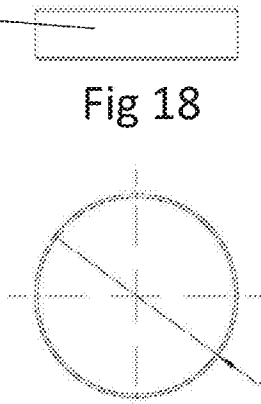
Fig 19
Fig 18
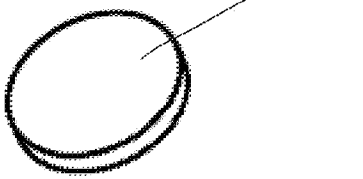
Fig 21

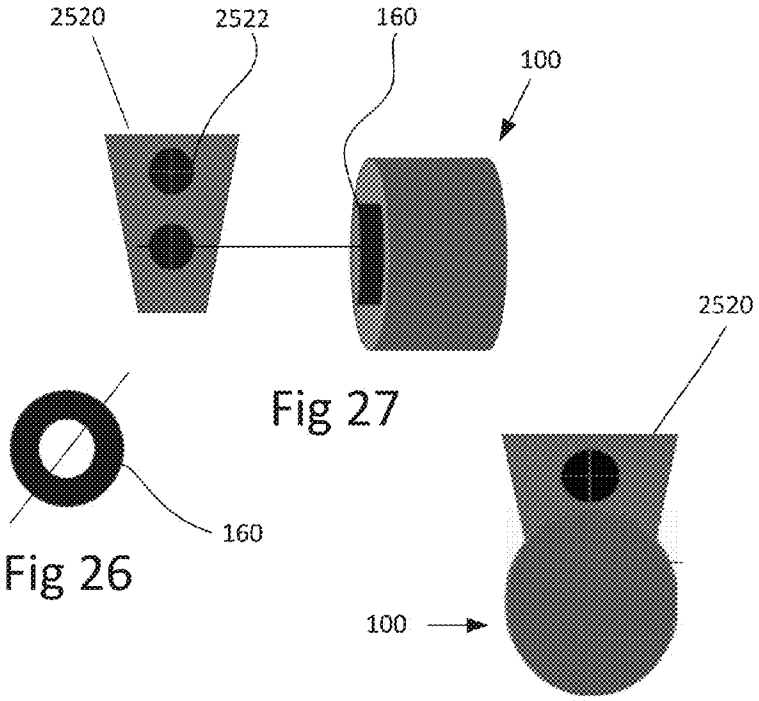
Fig 26
Fig 27
Fig 28
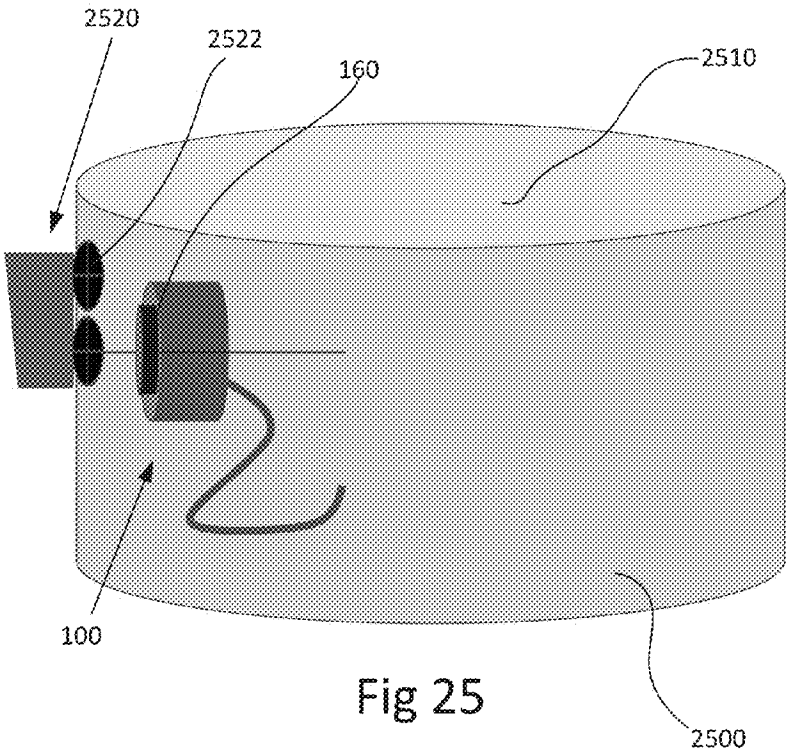
Fig 25

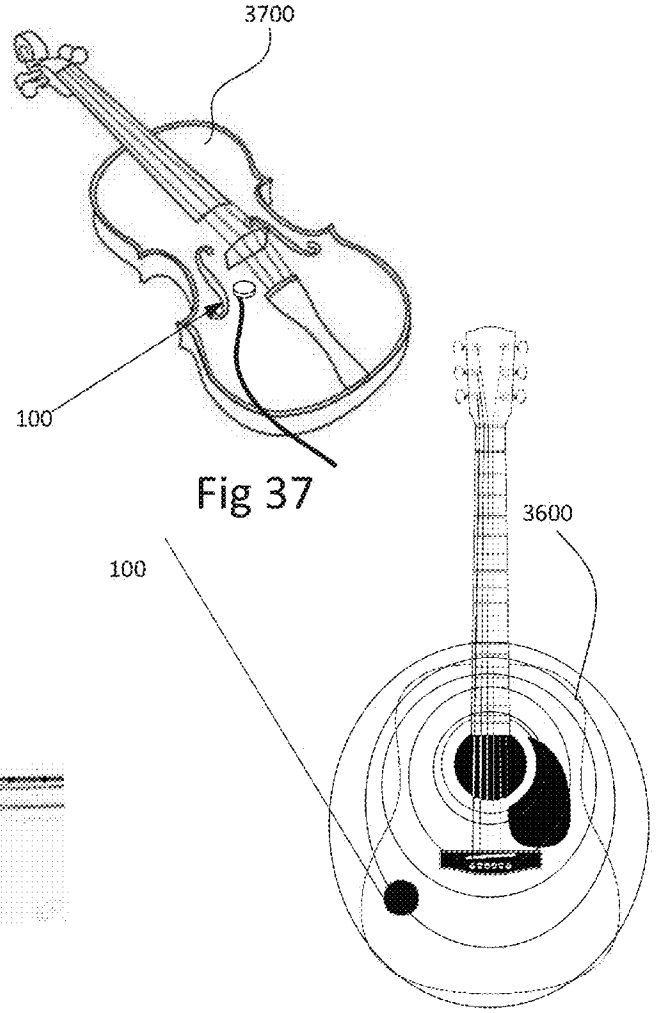
Fig 37
Fig 36B
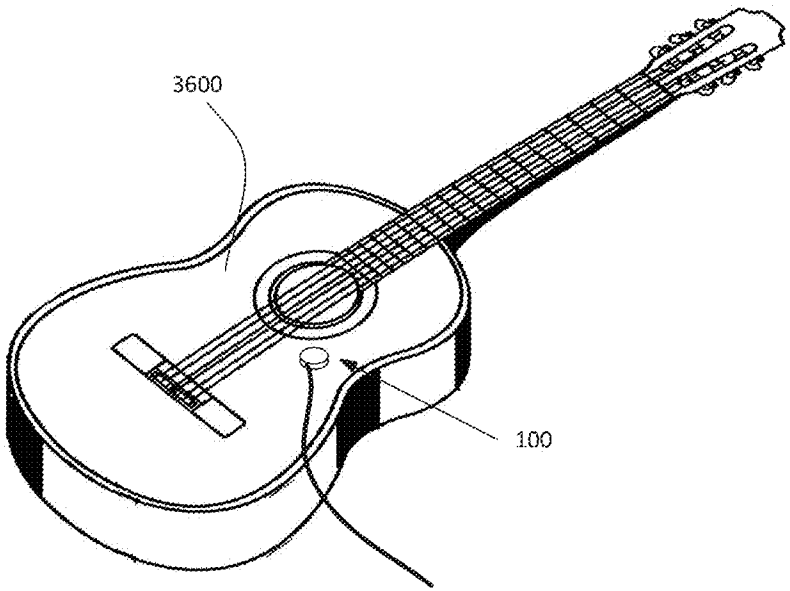
Fig 36
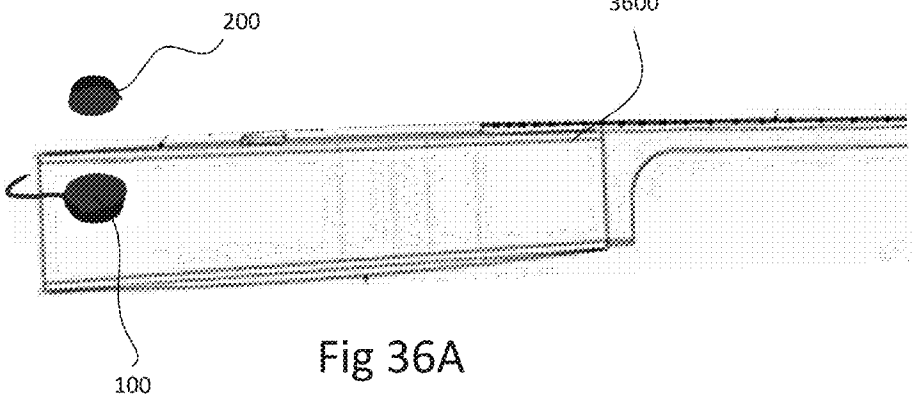
Fig 36A

[PRIOR ART]

MAGNETICALLY SECURED INSTRUMENT TRIGGER

CROSS REFERENCE TO RELATED APPLICATIONS

The present application is a continuation-in-part of and claims benefit of priority to U.S. patent application Ser. No. 14/988,570, entitled MAGNETICALLY SECURED INSTRUMENT TRIGGER, filed Jan. 5, 2016, which claims benefit of priority to U.S. Provisional Patent Application 62/259,047, entitled PIEZOELECTRIC INSTRUMENT TRIGGER, filed Nov. 23, 2015, and to U.S. Provisional Patent Application 62/100,041, entitled DUAL SIDED MAGNETIC DRUM TRIGGER, filed Jan. 5, 2015; and claims priority to U.S. Provisional Patent Application 62/448,388, entitled MAGNETICALLY SECURED INSTRUMENT TRIGGER AND INSTRUMENT TRIGGER MOUNTING SYSTEMS AND METHODS, filed Jan. 19, 2017, and U.S. Provisional Patent Application 62/448,953, entitled MAGNETICALLY SECURED INSTRUMENT TRIGGER AND INSTRUMENT TRIGGER MOUNTING SYSTEMS AND METHODS, filed Jan. 20, 2017, each of which are incorporated herein in their entirety.

FIELD OF THE INVENTION

The field of the invention is electronic instrument triggers.

BACKGROUND

The background description includes information that may be useful in understanding the present invention. It is not an admission that any of the information provided herein is prior art or relevant to the presently claimed invention, or that any publication specifically or implicitly referenced is prior art.

In the past few decades, drum triggers have increasingly been used with acoustic drums for live performances and studio recordings. In many instances, drum triggers can overcome potential problems with using microphones and can allow a drummer to have more control over the sound of the drum. In effect, the addition of a drum trigger to an acoustic drum converts the acoustic drum to an electric drum pad.

There are several existing varieties of drum triggers. A first type of prior art drum trigger involves a tension arm that is mounted on the rim of a drum using a lug or clamp mount mechanism. For this type of drum trigger, a tension arm attached to the rim of the drum puts pressure on the trigger and places the trigger in contact with the head of the drum. This has several undesirable effects. First, this puts stress on the head of the drum thereby deforming the drum head. This affects the tonal quality of the drum and changes the sound produced by the drum head. Second, the tension applies unnecessary force to the trigger and can cause it to fail because of the mechanical stress placed on the trigger. Third, when the drum is struck, and the drum head vibrates, the trigger will not be in constant contact with the drum head. This can cause problems including double triggering of the trigger. Fourth, the location of the trigger is limited to a position near the rim of the drum. Fifth, the trigger is susceptible to movement and requires frequent re-adjustment. Problems with the position and mechanical issues with the trigger can occur in a few as 150-300 strikes of the drum head, and the majority of prior art triggers begin to suffer from degrading performance beginning with the first strike of the drum. The degrading performance may take the form of a decreased voltage output, noticeable as a decreased amplitude of the output voltage wave, and may also include increases in non-triggering or double triggering. Additionally, the piezoelectric transducer commonly used in these triggers may begin to degrade or wear out quickly because it is placed in high-stress direct contact with the drum head. The very design of prior art triggers causes the triggers to suffer from the aforementioned problems.

This type of tension arm trigger is also difficult to install and configure. The tension arm trigger requires exact tension be placed on the trigger itself to keep the trigger in constant contact with a drum head. This type of installation is finicky and requires expertise or trial-and-error to install correctly. The prior art triggers also require considerable configuration at a drum module. A drum module is an electronic device that interprets an input and produces as an output a sound or other electronic output. A plurality of drum modules, their specifications and methods of operation are described hereinbelow. For prior art triggers, the drum module will need to specifically tuned to not only the type of trigger, but the manner in which the trigger is installed and the type of instrument on which the trigger is installed. The configuration must also take into account other external conditions at the time of configuration. The exact same trigger may need different configuration settings each time the trigger is set up for use.

Many external drum triggers are top rim mounted, but these suffer from the described defects. For example, top rim triggers are bulky and may get in the way of a drummer's performance. One way to overcome this defect is to install the drum trigger on the drum head. U.S. Pat. No. 7,259,317 to Hsien describes an external drum trigger that can be added to a drumhead and is incorporated by reference herein in its entirety. However, the drum trigger described in Hsein suffers from numerous drawbacks. First, installation of the drumhead in Hsein requires a hole to be created in the drumhead, which permanently damages the drum. Second, the drumhead in Hsein requires a foam buffer, which can decrease the sensitivity of the drum trigger and result in a degradation in response as it is applied to larger drums. U.S. Pat. No. 5,977,473 to Adinolfi describes a drum trigger incorporated into the rim of a drum and is incorporated by reference herein in its entirety. However, the drum trigger described in Adinolfi is undesirable because it requires the purchase of a completely new drum. Because of this, in many instances external or add-on drum triggers are more favorable.

Another type of prior art drum trigger is a pad installed trigger. Typically these triggers are glued using an epoxy or adhesive to a plate on the underside of a rubber or silicone drum pad. These triggers suffer from problems including a loss of velocity, double triggering, and frequent mechanical failure. The drum pad triggers that incorporate piezoelectric triggers prevent the piezoelectric trigger from functioning properly because the piezoelectric trigger cannot flex properly. The adhesive and solid plate the trigger is disposed on force the trigger to remain rigid and essentially cause the trigger to function as a contact microphone instead of as a proper trigger. Drum triggers may also be glued or otherwise adhered to a drum head directly without an intervening plate or pad. However, this method of attachment is undesirable because it permanently attaches the trigger to the drum head and puts undue stress on the trigger itself.

Additional information about problems that exist with prior art triggers and methods for installing, configuring, and using prior art drum triggers can be found in Norman Weinberg, *Tweaking For Touch: The Electronic Trigger*, Drum! Magazine, June 2011, and in Mike Snyder, *Don't Pull That Trigger!*, Drum! Magazine, November 2013, both of which are hereby incorporated by reference in their entirety. The function and operation of piezoelectric transducers and the piezoelectric effect is well known in the art. A description of the functioning of a piezoelectric transducer can be found in the article *Piezoelectric Trasnsducers*, NDT Resource Center, https://www.nde-ed.org/EducationResources/CommunityCollege/Ultrasonics/EquipmentTrans/piezotransducers.htm, accessed Jan. 5, 2016, which is incorporated by reference herein in its entirety. Additional information on piezoelectric transducers can be found in the article *What's a Transducer?*, APC International, LTD, https://www.americanpiezo.com/piezo-theory/whats-a-transducer.html, accessed Jan. 5, 2016, which is incorporated by reference herein in its entirety. Detail on the mechanics and function of piezoelectric transducers can be found in the article *Introduction to Piezo Transducers*, Piezo Systems, Inc., http://www.piezo.com/tech2intropiezotrans.html, accessed Jan. 5, 2016, which is incorporated by reference herein in its entirety.

All extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is a need for improved drum triggers that do not require modification of the drums and that may be releaseably attached at a variety of locations. Additionally there is a need for an improved drum trigger that may be used with a plurality of drum triggers on a single instrument without cross-talk interference or hot-spotting.

SUMMARY OF THE INVENTION

The present invention provides apparatus, systems, and methods in which a drum trigger has a first member, which may be a securing device, and a second member, which may be a trigger, which go on either side of a drumhead. The securing device can magnetically couple to the trigger, such that the drumhead is interposed between the securing device and the trigger. This configuration allows the trigger to attach directly to the drumhead without modifying or damaging the drumhead.

In some embodiments, the securing device and trigger contain magnets, and in some embodiments, the magnets are rare-earth element magnets, such as neodymium magnets.

In some embodiments, the drum trigger further comprises a sound-receiving element, such as a piezoelectric transducer, which translates the vibrations of the drum when played into a digital or analog electrical signal. In some embodiments, the sound-receiving element is protected by a silicone buffer layer and is disposed on the bottom of the drum trigger. The sound-receiving element is only attached or secured to the housing of the drum trigger at the edges of the sound-receiving element, thereby allowing the sound-receiving element to properly flex and function as designed. The sound-receiving element, (e.g. piezoelectric transducer) is electrically coupled to an analog or digital sound management system. In some embodiments, the digital sound management system is a drum sound module, and the piezoelectric transducer is connected to the drum sound module via a TRS jack.

Because at least a portion of the drum trigger can rest on top of the drumhead, it is contemplated that in some embodiments at least a portion of the drum trigger is covered in an impact-resistant gel coating or secured within a housing.

The drum trigger of the present invention is advantageous over prior art drum trigger devices because it is more accurate, more durable, and easier to use than the prior art drum trigger devices. The drum trigger of the present invention is magnetically secured to the drum head, drum shell, or drum lug. This enables the trigger to move with the vibrations of the drum or instrument on which it is disposed while capturing the exact vibrations and tone of the instrument. The present invention can pick up the strike of the drum without being subject to the mechanical force that causes problems with the prior art triggers. For example, with the tension arm triggers the tension arm itself is exerting a mechanical force on the trigger in an attempt to keep the trigger in physical contact with the drum head. The tension arm trigger cannot achieve constant contact and the trigger will "bounce" or be out of physical contact with the drum head after the drum head is struck. The trigger of the present invention overcomes this problem by moving with the drum head. The drum trigger of the present invention may move up and down with the vibrations of the drum head and is not subject to any additional forces or impacts. This enables the trigger of the present invention to accurately capture the exact sound and tone of the drum strike. The accurate sound capture is further improved because of the manner in which the piezoelectric transducer is disposed in the trigger. The piezoelectric transducer is secured only around the perimeter of the transducer, thereby providing the transducer with the ability to flex and function as designed. Unlike prior art drum trigger designs which cause the piezoelectric transducer to be in a rigid configuration, the drum trigger of the present invention enables the piezoelectric transducer to flex without causing double triggering or velocity gaps. A velocity gap is a "gap" in the MIDI input range, typically 0-127, that is not captured by a trigger. This can be a "flat spot" in the range, where jumps from one value to another occur, or "dead spots" where a portion of the range is not captured at all. A double triggering event is where a single strike of a drum or similar musical activity causes the trigger to send a single output that is interpreted as two events. A non-triggering event is where a single strike of a drum or similar musical activity causes the trigger to send a single output that is not interpreted as any event.

The manner of securing the drum trigger of the present invention to the drum head also enables a drum module to be easily configured with the drum trigger. The amount of configuration that is necessary is minimal and does not require the tedious trial-and-error required by prior art drum triggers. When installed and configured the drum trigger of the present invention virtually eliminates instances of velocity gapping, double triggering, and non-triggering. The design and manner of installation of the drum trigger of the present invention also When installed, the drum trigger of the present invention enables a musician to accurately capture the exact playing style used. The drum trigger of the present invention captures the full range of MIDI velocity, the exact tone of the instrument, and the playing style of the individual musician using the drum trigger, which is something that prior art triggers are unable to achieve.

The drum trigger of the present invention has a broad application on any component of a drum kit including snare drums, toms, bass or kick drums, cymbals, and other percussion instruments. The drum trigger of the present invention may be mounted on the shell, rim, lug, or head of a drum and is compatible with all drum head and drum shell types including natural hide drum heads, fabric drum heads, mesh heads, wood drum shells, acrylic drum shells, metal drum lugs, etc. Problems that occur with the prior art drum triggers on smaller drums are exacerbated on larger drums such as kick drums. For example, problems with double triggering and durability that may exist when prior art drum triggers are used on a 13" snare drum are greatly magnified when the prior art drum triggers are used on a 22" bass drum as the drum exerts a greater force on the prior art drum trigger. The drum trigger of the present invention is not susceptible to any of these problems because of the way may be magnetically installed on a drum head, shell, or lug and because of the manner in which the piezoelectric transducer is secured within the housing of the trigger.

The present invention trigger may also be used with other acoustic instruments including guitars, violins, cellos, basses, etc. as a musical instrument pickup.

Various objects, features, aspects and advantages of the inventive subject matter will become more apparent from the following detailed description of preferred embodiments, along with the accompanying drawing figures in which like numerals represent like components.

In a first embodiment the present invention provides a trigger system for sending a signal based on a detected vibration, the trigger system comprising: a trigger comprising: a housing, the housing having a top with an opening disposed in the top, a bottom, the bottom being substantially open, and a pass-through opening; a grommet disposed in the top opening of the housing; a magnet disposed within and secured within the housing; a piezoelectric transducer having a ceramic top and a brass bottom and disposed at the bottom of the housing, the piezoelectric transducer being electrically and physically isolated from the magnet by a first buffer layer disposed between the magnet and the piezoelectric transducer within the housing, and wherein the piezoelectric transducer is enclosed within the housing by a second buffer layer being disposed on the brass bottom of the piezoelectric transducer at the bottom of the housing.

The system may further comprise a securing device, the securing device comprising a housing and a magnet disposed within the housing. The system may further comprise a drum module. The system further adapted to send an electrical signal from the piezoelectric transducer of the trigger to the drum module to cause the drum module to execute a function. The system wherein the function is the playback of a recorded or generated drum sound determined based on the electrical signal from the piezoelectric transducer of the trigger. The system wherein the trigger magnet and securing device magnet comprise neodymium rare earth magnets. The system wherein the first buffer layer and second buffer layer comprise a thin silicone sheet. The system wherein the magnet, first buffer layer, second buffer layer, and piezoelectric transducer are secured by an adhesive in the housing of the trigger. The system wherein the adhesive is an epoxy. The system wherein the magnet is secured within the housing by a set of locking tabs. The system wherein the piezoelectric transducer is disposed within a rim or annular recess formed or provided in the bottom of the housing. The system may further comprise wherein an electrical lead is electrically connected to a set of electrical terminations on the piezoelectric transducer, and wherein the electrical lead passes through the pass-through of the housing. The system wherein the electrical lead is supported by a strain relief means. The system wherein the securing device is adapted to releaseably and magnetically secure the trigger to a drum head, wherein the securing device is disposed on a top of the drum head and the trigger is disposed on a bottom of a drum head. The system wherein the drum is one of a mesh drum head or an acoustic drum head. The system may further comprise a drum shell with an interior and an exterior and having a set of tensioners disposed on the exterior and attached to the drum shell by a set of lugs disposed on said interior, wherein the grommet of the trigger is adapted to fit on one of said lugs and the magnet of the trigger is adapted to releaseably and magnetically secure the trigger to said one of said lugs. The system may further comprise a drum shell with an interior and an exterior wherein the securing device is adapted to releaseably and magnetically secure the trigger to the drum shell, wherein the securing device is disposed on the exterior of the drum shell and the trigger is disposed on the interior of the drum shell. The system wherein the trigger is adapted to be secured to a stringed acoustic instrument. The system wherein the trigger is adapted to not be affected by cross-talk.

In another embodiment the present invention provides a method for causing an electronic module to perform a function based on a detected vibration from a musical instrument, the method comprising: releaseably securing a trigger to an instrument, the trigger comprising: a housing, the housing having a top with an opening disposed in the top, a bottom, the bottom being substantially open, and a pass-through opening; a grommet disposed in the top opening of the housing; a magnet disposed within and secured within the housing; a piezoelectric transducer having a ceramic top and a brass bottom and disposed at the bottom of the housing, the piezoelectric transducer being electrically and physically isolated from the magnet by a first buffer layer disposed between the magnet and the piezoelectric transducer within the housing, and wherein the piezoelectric transducer is enclosed within the housing by a second buffer layer being disposed on the brass bottom of the piezoelectric transducer at the bottom of the housing; and an electrical lead connected through the pass-through opening in an operative electrical connection with the piezoelectric transducer; connecting the electrical lead to the electronic module; causing the musical instrument to emit the vibration; sending an electrical signal by the electrical lead from the piezoelectric transducer to the electronic module; receiving at the electronic module the electrical signal; determining, at the electronic module, which function from a set of functions to execute based on the received electrical signal; and executing, by the electronic module, the determined function.

The method may further comprise wherein the trigger is secured to the instrument by a securing device, the securing device comprising a magnet disposed within a housing. The method may further comprise wherein the instrument is selected from the group consisting of: a snare drum, a bass drum, a tom drum, and a cymbal. The method may further comprise wherein the electrical signal is sent at one of 127 signal levels. The method may further comprise wherein set of functions stored in the electronic module comprise a set of recorded or generated musical instrument sounds. The method may further comprise wherein the electronic module is a drum module. The method may further comprise wherein the drum module comprises a set of input ports. The method may further comprise wherein determining is based on which input port from the set of input ports the electrical lead from the trigger is connected to. The method may further comprise determining a configuration for the electronic module from a set of configurations stored in the electronic module.

In yet another embodiment the present invention provides a method for configuring an electronic module, the method comprising: releaseably securing a trigger to an instrument, the trigger comprising: a housing, the housing having a top with an opening disposed in the top, a bottom, the bottom being substantially open, and a pass-through opening; a grommet disposed in the top opening of the housing; a magnet disposed within and secured within the housing; a piezoelectric transducer having a ceramic top and a brass bottom and disposed at the bottom of the housing, the piezoelectric transducer being electrically and physically isolated from the magnet by a first buffer layer disposed between the magnet and the piezoelectric transducer within the housing, and wherein the piezoelectric transducer is enclosed within the housing by a second buffer layer being disposed on the brass bottom of the piezoelectric transducer at the bottom of the housing; and an electrical lead connected through the pass-through opening in an operative electrical connection with the piezoelectric transducer; connecting the electrical lead to an input from a set of inputs on the electronic module; inputting in a software program on a computer a set of parameters, the set of parameters comprising: a trigger type; a trigger securing method; an instrument type; and an instrument configuration; determining, by the software program based on the set of parameters, a set of suggested settings for the electronic module; and configuring the electronic module based on the set of suggested settings.

In another embodiment, the present invention provides a trigger system for generating a signal derived from a vibration detected upon a user operating a musical instrument, the trigger system comprising: a trigger adapted to be removably mounted onto a musical instrument and comprising: a housing; a magnet disposed and secured within the housing and adapted to removably secure the trigger to the musical instrument; a piezo-electric transducer having an electrical output and being disposed within the housing, the piezo-electric transducer being essentially electrically and physically isolated from the magnet and adapted to generate an electrical signal in response to a detected mechanical vibration associated with operation of the musical instrument.

The system of the above embodiment may further comprise a securing device, the securing device comprising a second housing and a second magnet disposed within the second housing, whereby with the trigger disposed opposite the securing device the respective magnets are attracted to each other with a component of the musical instrument disposed between the trigger and the securing device. The system may further comprise an electronic drum module comprising a set of inputs in electrical communication with the trigger electrical output and being adapted to process the trigger electrical output signal and produce an audio signal representative of a sound associated with operation of a musical instrument. The system may further be adapted to send an electrical signal from the piezo-electric transducer of the trigger to the drum module to cause the drum module to execute a function. The function may be the playback of a recorded or generated drum sound determined based on the electrical signal from the piezo-electric transducer of the trigger. The trigger magnet may be a type of rare earth magnet. The trigger magnet may be from the group consisting of neodymium-based rare earth magnet, ceramic composite, ferrite composite, barium or strontium carbonate, iron-oxide composite, samarium cobalt, neodymium iron boron. The housing may comprise a top with an opening disposed in the top, a bottom, the bottom being substantially open, and a pass-through opening; and further comprising a grommet disposed in the top opening of the housing. The piezo-electric transducer may be disposed within an annular recess provided in the bottom of the housing. The system may further comprise an electrical lead electrically connected to a set of electrical terminations on the piezo-electric transducer, and wherein the electrical lead passes through a pass-through opening of the housing. The electrical lead may be supported by a strain relief means. The securing device may be adapted to releaseably and magnetically secure the trigger to a drum head, wherein the securing device is disposed on a top of the drum head and the trigger is disposed on a bottom of a drum head. The musical instrument may be a drum having one of a mesh drum head or an acoustic drum head. The housing may comprise a top with an opening disposed in the top, a bottom, the bottom being substantially open, and a pass-through opening; and further comprising a grommet disposed in the top opening of the housing, wherein the trigger is adapted to mount onto a drum shell having an interior, an exterior, and a set of tensioners disposed on the exterior and attached to the drum shell by a set of lugs disposed on said interior, and wherein the grommet of the trigger is adapted to fit on one of the set of lugs and the magnet of the trigger is adapted to releaseably and magnetically secure the trigger thereto. The system may further comprise a drum shell with an interior and an exterior wherein the securing device is adapted to releaseably and magnetically secure the trigger to the drum shell, wherein the securing device is disposed on the exterior of the drum shell and the trigger is disposed on the interior of the drum shell. The musical instrument may be a stringed instrument and the trigger is adapted to be secured to the stringed instrument. The piezo-electric transducer may further comprise a ceramic top and a brass bottom and wherein the piezo-electric transducer is enclosed within the housing by a second buffer layer being disposed on the brass bottom of the piezo-electric transducer at a bottom of the housing.

In another embodiment, the present invention provides a method for causing an electronic module to perform a function based on a detected vibration from a musical instrument, the method comprising: releaseably securing a trigger to a musical instrument, the trigger comprising: a housing; a magnet disposed and secured within the housing and adapted to removably secure the trigger to the musical instrument; and a piezo-electric transducer having an electrical output and being disposed within the housing, the piezo-electric transducer being essentially electrically and physically isolated from the magnet and adapted to generate an electrical signal in response to a detected mechanical vibration associated with operation of the musical instrument; placing the trigger electrical output in electrical communication with the electronic module; generating a trigger output signal in response to a detected mechanical vibration emitted by the musical instrument; sending the trigger electrical output signal to the electronic module; receiving at the electronic module the trigger electrical output signal; determining, at the electronic module, which function from a set of functions to execute based on the received trigger electrical output signal; and executing, by the electronic module, the determined function.

The method may further comprise wherein the trigger is secured to the instrument by a securing device, the securing device comprising a magnet disposed within a housing. The instrument may be selected from the group consisting of: a snare drum, a bass drum, a tom drum, and a cymbal. The electrical signal may be sent at one of 127 signal levels. The set of functions stored in the electronic module may comprise a set of recorded or generated musical instrument sounds. The electronic module may be a drum module. The drum module may comprise a set of input ports. The determining may be based on which input port from the set of input ports the electrical lead from the trigger is connected to. The method may further comprise determining a configuration for the electronic module from a set of configurations stored in the electronic module.

In another embodiment, the present invention provides a method for configuring an electronic module, the method comprising: releaseably securing a trigger to an instrument, the trigger comprising: a housing; a magnet disposed and secured within the housing and adapted to removably secure the trigger to the musical instrument; a piezo-electric transducer having an electrical output and being disposed within the housing, the piezo-electric transducer being essentially electrically and physically isolated from the magnet and adapted to generate an electrical signal in response to a detected mechanical vibration associated with operation of the musical instrument; and placing the trigger electrical output in electrical communication with the electronic module; generating a trigger output signal in response to a detected mechanical vibration emitted by the musical instrument; sending the trigger electrical output signal to the electronic module; receiving at the electronic module the trigger electrical output signal; inputting in a software program on a computer a set of parameters, the set of parameters comprising: a trigger type; a trigger securing method; an instrument type; and an instrument configuration; determining, by the software program based on the set of parameters, a set of suggested settings for the electronic module; and configuring the electronic module based on the set of suggested settings.

In another embodiment, the present invention provides a method for causing an electronic module to perform a function based on a detected vibration from a percussion instrument, the method comprising: releaseably securing a trigger to a percussion instrument, the trigger comprising: a housing; a magnet disposed and secured within the housing and adapted to removably secure the trigger to the percussion instrument; and a piezo-electric transducer having an electrical output and being disposed within the housing, the piezo-electric transducer being essentially electrically and physically isolated from the magnet and adapted to generate an electrical signal in response to a detected mechanical vibration associated with operation of the percussion instrument; placing the trigger electrical output in electrical communication with the electronic module; generating a trigger output signal in response to a detected mechanical vibration associated with operation of the percussion instrument; sending the trigger electrical output signal to the electronic module; receiving at the electronic module the trigger electrical output signal; determining, at the electronic module, which function from a set of functions to execute on the received trigger electrical output signal; and executing, by the electronic module, the determined function.

In the method of the above embodiment, the trigger further may further comprise a second magnet, the second magnet disposed opposite the first magnet with a striking surface of the percussion instrument disposed between the first and second magnets, and wherein the piezo-electric transducer is disposed intermediate the first magnet and the striking surface and in vibrational communication with the striking surface. The trigger may further comprise a plastic membrane disposed intermediate the piezo-electric transducer and the striking surface. The trigger electrical output signal may have a range of 127 signal levels. The set of functions stored in the electronic module may comprise a set of recorded or generated musical instrument sounds. The electronic module may be a drum module comprising wherein the drum module comprises a set of input ports and wherein the determining is based on which input port from the set of input ports receives the trigger electrical output signal. The method may further comprise determining a configuration for the electronic module from a set of configurations stored in the electronic module. The determining a configuration of the electronic module may further comprise: inputting in a software program on a computer a set of parameters, the set of parameters comprising: a trigger type; a trigger securing method; an instrument type; and an instrument configuration; determining, by the software program based on the set of parameters, a set of suggested settings for the electronic module; and configuring the electronic module based on the set of suggested settings. The method may further comprise wherein a gap physically separates the piezo-electric transducer and the magnet to allow the piezo-electric transducer to freely vibrate in response to the detected mechanical vibration at the striking surface of the percussion instrument.

In yet another embodiment, the present invention provides a trigger system for generating a signal for output to an electronic module for generating sound associated with a musical instrument, the signal derived from a vibration detected upon a user operating a percussion instrument, the trigger system comprising: a trigger adapted to be removably mounted onto a percussion instrument and comprising: a housing; a magnet disposed and secured within the housing and adapted to removably secure the trigger to the percussion instrument; a piezo-electric transducer having an electrical output and being disposed within the housing, the piezo-electric transducer being essentially electrically and physically isolated from the magnet and adapted to generate an electrical signal in response to a detected mechanical vibration associated with operation of the percussion instrument an electrical lead connected to the piezo-electric transducer electric output and in electrical communication with an input of an electronic module adapted to produce sounds representing musical instrument sounds based on the electrical signal.

The trigger system of the above embodiment the electrical lead may pass through a pass-through opening of the housing and is supported by a strain relief mechanism to prevent undesired disconnection with the piezo-electric transducer electrical output. The trigger system may further comprise a second magnet, the second magnet disposed opposite the first magnet with a striking surface of the percussion instrument disposed between the first and second magnets, and wherein the piezo-electric transducer is disposed intermediate the first magnet and the striking surface and in vibrational communication with the striking surface. The trigger system may further comprise a plastic membrane disposed intermediate the piezo-electric transducer and the striking surface. The trigger system may further comprise a supplemental restraint mechanism adapted to assist in holding the trigger in place once placed on a percussion instrument. The supplemental restraint mechanism may be one of the group comprising: adhesive, adhesive material, and an anchor arm attached to a non-striking surface of the percussion instrument.

BRIEF DESCRIPTION OF THE DRAWING

In order to facilitate a full understanding of the present invention, reference is now made to the accompanying drawings, in which like elements are referenced with like numerals. These drawings should not be construed as limiting the present invention, but are intended to be exemplary and for reference.

FIGS. 16 and 17 provide side and plan views respectively of an exterior silicone buffer layer according to the present invention.

FIGS. 18 and 19 provide side and plan views respectively of a trigger magnet according to the present invention.

FIGS. 20 and 21 provide side and plan views respectively of an adapter post according to the present invention.

FIGS. 25, 26, 27, and 28 provide diagrams of a trigger disposed on a drum lug in a drum shell according to the present invention.

FIGS. 36, 36A, 36B, and 37 provide line drawings of a trigger disposed on a guitar and a violin, respectively according to the present invention.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Figure 1:
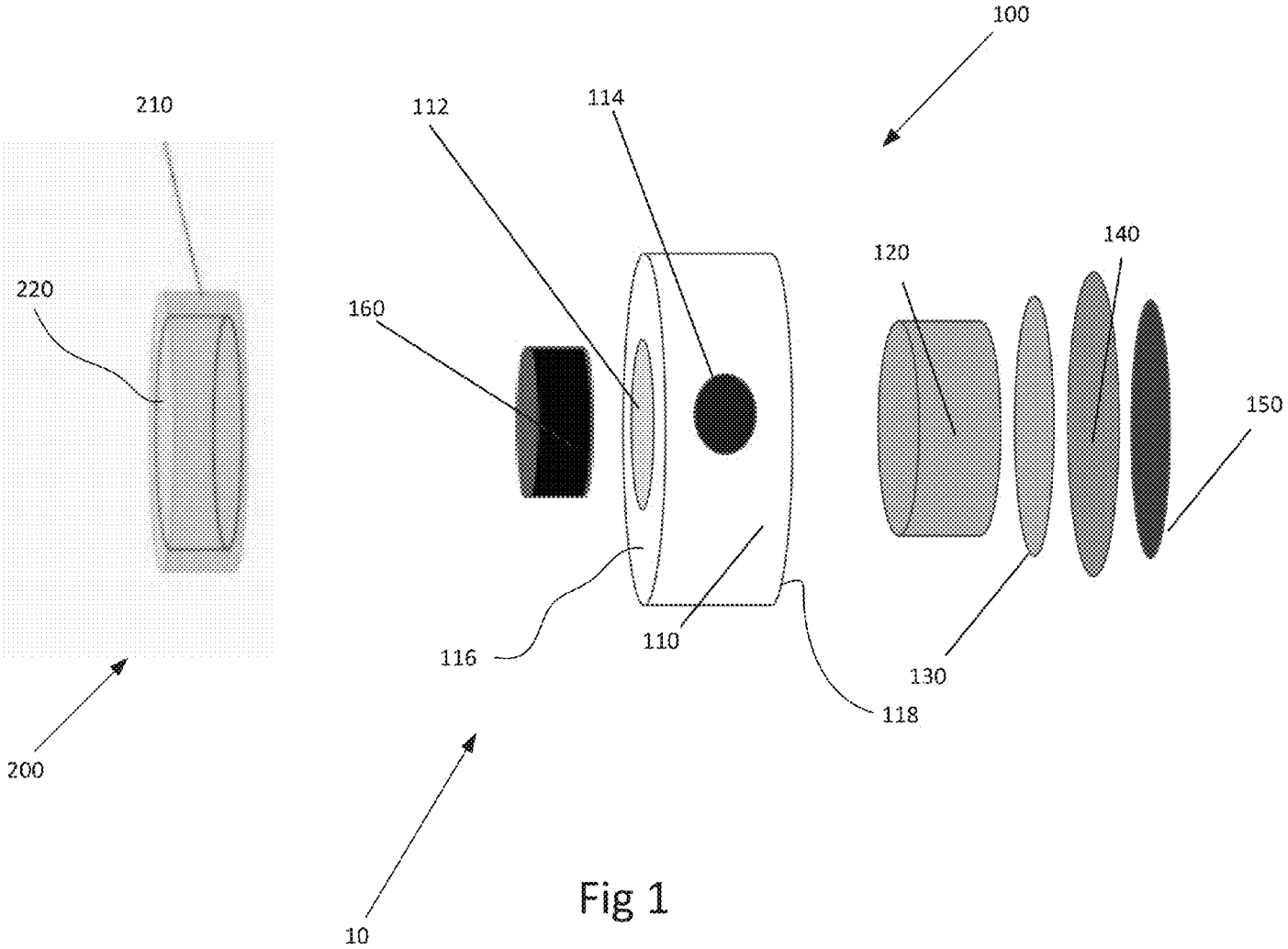
FIG. 1 provides a side view of the component parts of a trigger system according to the present invention.

With reference to FIG. 1, a side view of the primary component parts of a trigger system 10 according to one embodiment of the present invention is provided. The trigger system 10 comprises a trigger 100 and a securing device 200. The trigger 100 comprises a housing body 110 being substantially hollow and having an opening 112 at the top 116, and being substantially open at the bottom 118. The housing body 110 also has a pass-through opening 114 on the side of the housing. Magnet 120 is disposed within the housing body 110 and may be secured to the housing body 110 by an adhesive such as an epoxy or by a set of securing tabs. Silicone buffer layer 130 is disposed between the magnet 120 and the piezoelectric transducer 140. Piezoelectric transducer 140 is disposed at the bottom of the housing body 110 and may sit in a lip, ridge, or indentation at the bottom of the housing and may be secured by an adhesive such as an epoxy. Silicone buffer layer 150 is disposed on the exterior of the bottom 118 of the housing 110.

The housing body 110 of the trigger 100 may be substantially cylindrical, cuboid, or any other suitable shape. The top 116 of the housing may not have opening 112 and may instead be flat and covered in a buffer layer composed of silicone, foam, foam-rubber, or other suitable material. In a preferred embodiment, the silicone buffer layer 130 and silicone buffer layer 140 will comprise a thin layer of silicone secured in the housing body 110 by an adhesive such as an epoxy. However, the silicone buffer layer 130 and silicone buffer layer 140 may also be secured directly to the magnet 120 and piezoelectric transducer 140 respectively. The silicone buffer layer 130 is adapted to provide a physical and electrical barrier between the magnet 120 and piezoelectric transducer 140, and may comprise any other suitable material such as rubber or foam. The silicone buffer layer 150 is adapted to provide a non-skid and impact resistant layer on the bottom 118 of the trigger housing 110, and may comprise any other suitable material such as rubber or foam. The silicone buffer layer 150 keeps the trigger 100 from sliding or shifting from its position even when the trigger 100 is subjected to intense vibrations. Grommet 160 is adapted to fit within the opening 112 on the top 116 of the housing 110, and may comprise a material such as rubber, silicone rubber, or similar suitable elastic material. The grommet 160 may have an opening and may be adapted to fit on and/or receive a lug, screw, or other similar protrusion. The magnet 120 in the trigger 100 may be a neodymium or similar rare earth magnet, which are strong permanent magnets made from alloys of rare earth elements, with suitable Gaussian pull strength, e.g. at least 2500 Gauss. The magnet 120 may comprise the following technical specifications: 20 mm diameter×5 mm thick (0.79" diameter×0.20" thick); material: Neodymium (NdFeB); grade: N48; coating: Nickel (Ni); magnetization: through thickness; and pull force: 19.68 pounds. The magnet 120 is adapted to releaseably and magnetically secure the trigger 100 to a ferrous or magnetic structure such as in the securing device 200. However, in some embodiments the magnet 120 may simply be a magnetically attractive plate or disk instead of a magnet and may be attracted to a magnet 220 in the securing device, or vice versa.

The securing device 200 comprises a housing 210 having an opening adapted to receive a magnet 220. Securing device 200 may also be a magnet 220 without housing 210 and having a coating such as a rubberized coating or an impact-resistant gel coating, such as plastic, plastic blend, rubber, rubber blend, or other suitable impact-resistant material. Similarly, the magnet 120 in the trigger 100 may also have a coating such as a rubberized coating or an impact-resistant gel coating, such as plastic, plastic blend, rubber, rubber blend, or other suitable impact-resistant material. The securing device 200 may also have an additional buffer layer on the bottom of the securing device 200 that may be comprised of silicone, rubber, or other suitable material. If used, this layer would aid in keeping the securing device in place and in magnetic attraction with the trigger 100.

The piezoelectric transducer 140 may also be any suitable sound-receiving unit capable of translating a mechanical signal (e.g. vibration of the drumhead) into an electrical (analog or digital) sound signal. The piezoelectric transducer 140 may have the following technical specifications: plate diameter: 27 mm (1.06 inches); element diameter: 20 mm (0.787 inches); plate thickness: 0.54 mm (0.021 inches); lead length: ~50 mm (1.96 inches); plate material: brass; resonant frequency (kHz): 4.6+/−0.5 kHz; resonant impedance (ohm): 300 maximum; and capacitance (nF): 20.0+/−30% [1 kHz].

Figure 3:
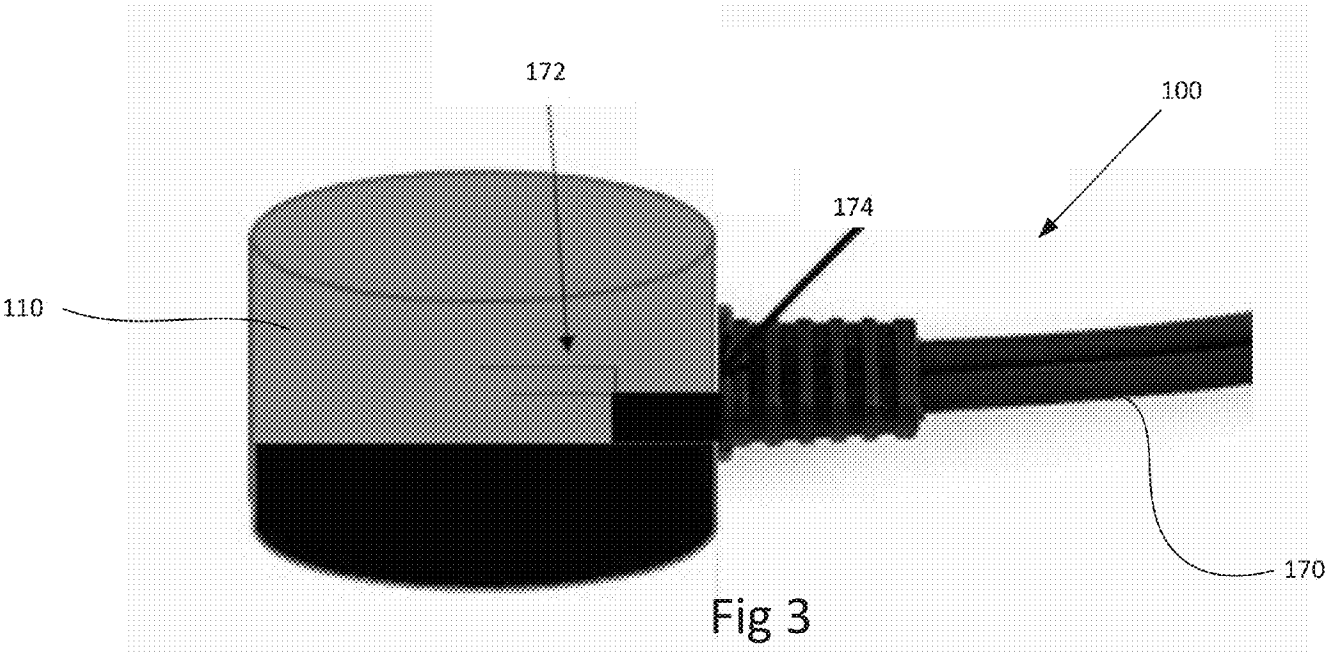
FIGS. 3 and 4 provide side and perspective views respectively of a trigger with a strain relief according to the present invention.

In one embodiment, the transducer 140 may instead be a force sensing resistor ("FSR") capable of producing differing voltages as force is applied to the sensor. Many modules, such as drum module 300 shown in FIG. 3, are not capable of using the output of an FSR. Furthermore, an FSR may not produce the desired outputs with similar accuracy and responsiveness compared to a piezoelectric transducer. However, the use of an FSR instead of a piezoelectric transducer 140 may be desirable in some applications. In some embodiments, the trigger system 10 is adapted to be mounted on a drum head in a "Thru-Head" configuration, shown in FIG. 24, a drum lug in a "Thru-Lug" configuration, shown in FIGS. 25-28, a drum shell in a "Thru-Shell" configuration, shown in FIG. 29, on a cymbal, shown in FIG. 30, on a cymbal stand, shown in FIGS. 31-35, or on another acoustic instrument, shown in FIGS. 36-37. The trigger system 10 may also be employed, placed, or installed by way of the magnet 120 or secured by the securing device 200 to translate a mechanical signal into an electrical signal in other suitable applications. The trigger 100 may also comprise a potentiometer or a resistor to provide an adjustment or resistance to the trigger 100 on the trigger 100 itself.

The use of rare earth magnets on the top in the securing device 200 and bottom in the trigger 100 of a drumhead provides a superior ability to capture and transfer vibrations from the playing surface to a piezoelectric transducer 140 regardless of the size of the drum. The strength of the magnets 120 and 220 also provides a dampening effect that makes it ideal for both electronic and hybrid drums with no permanent alterations to the drum. Additionally, by being magnetically attached, the trigger 100 may vibrate along with the surface or instrument on which it is attached without affecting the sound, tone, or timbre of the instrument. Floating also enables the trigger 100 to be far more sensitive than traditional drum triggers. Being magnetically attachable also enables the trigger 100 to be placed anywhere desired by the musician or user. Additionally, because the trigger 100 may be disposed within a drum or other instrument, the trigger is not likely to be damaged from being struck or impacted in normal use or operation as the only electronic components are inside the instrument out of harm's way.

Figure 45:
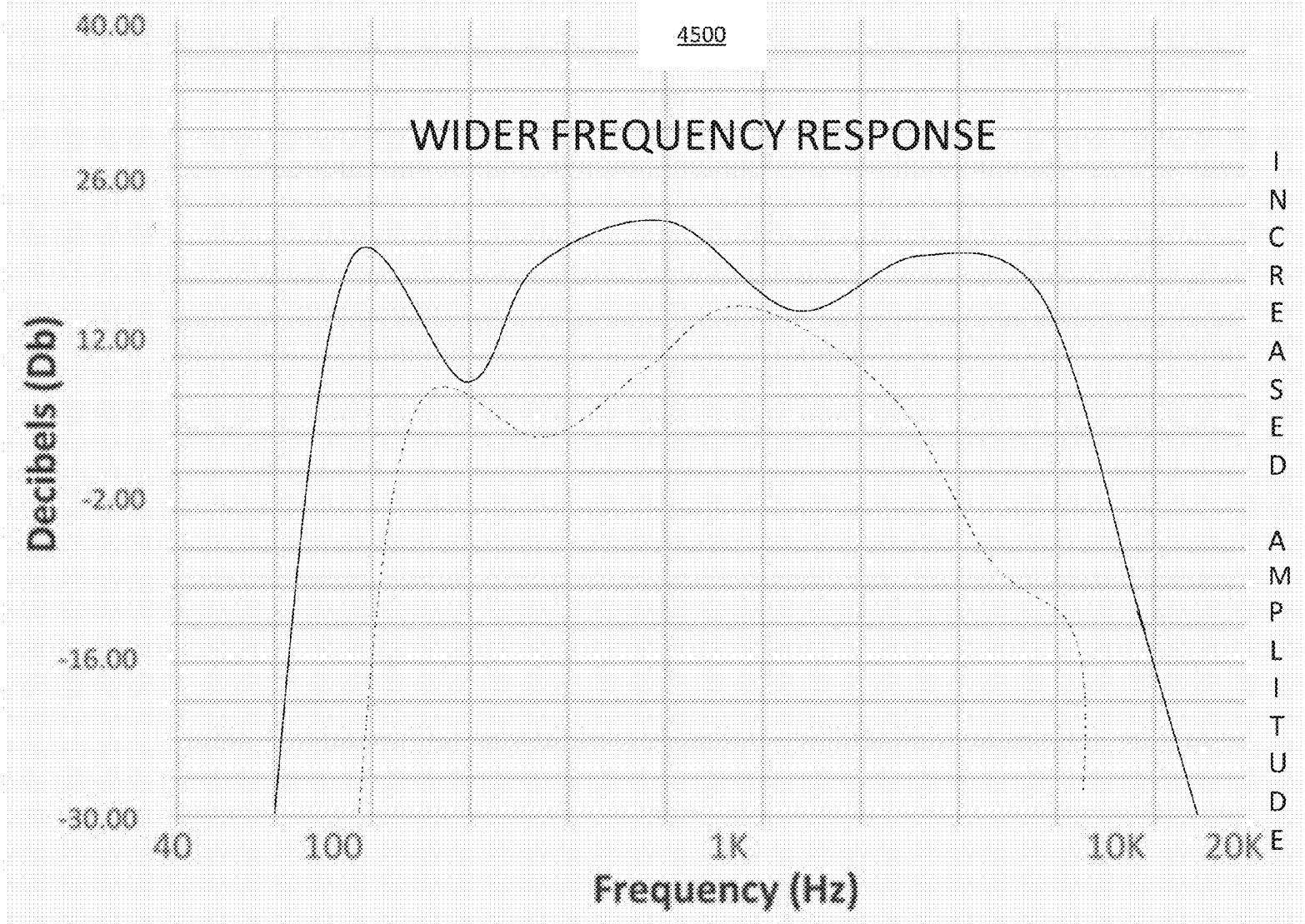
FIGS. 45, 46, 48A, 48B, 48C, 49, 50, 51, provide waveform illustrations of waveforms captured by the trigger of the present invention and by prior art trigger configurations.

The use of the trigger 100 provides increased frequency response and reduces the likelihood of double triggering, especially when used with a musical instrument as shown in FIGS. 36, 36A and 36B. The frequency response of the trigger 100 compared to a prior art trigger is shown in FIG. 45 wherein the frequency response of the trigger 100 is shown as the solid line and the prior art trigger response is shown as a dashed line. Chart 4500 in FIG. 45 shows the frequency spectrum for a G Chord played by an acoustic guitar. A prior art pick-up may have a drop of 7.5 kHz on the high end, and 78 Hz on the low end. The trigger 100 has a wider frequency spectrum and amplitude (volume or gain), from to 15 kHz on the high end and down to 65 Hz on the low end.

Figure 46:
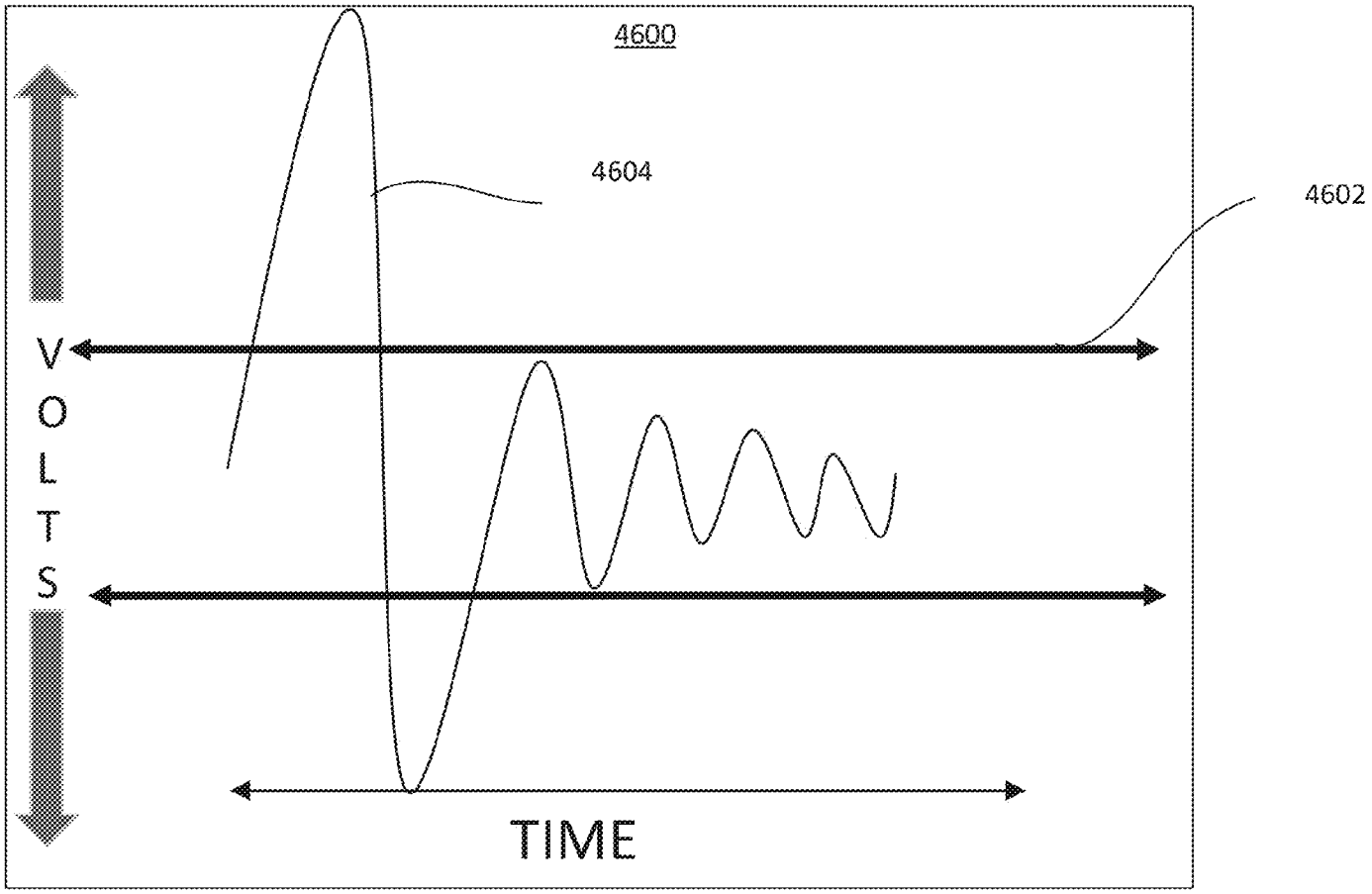

As shown in FIG. 46, trigger 100 records a clearer, more defined initial strike and has a more consistent waveform tapering after the initial strike. The waveform length is shorter resulting in a shorter decay time. This increases a module's, such as module 300 shown in FIG. 2, ability to capture strikes at short intervals. Additionally, the optimal headroom of the trigger 100 reduces re-triggering and allows reduced threshold settings in the module 300 creating a realistic velocity.

Figure 47B:
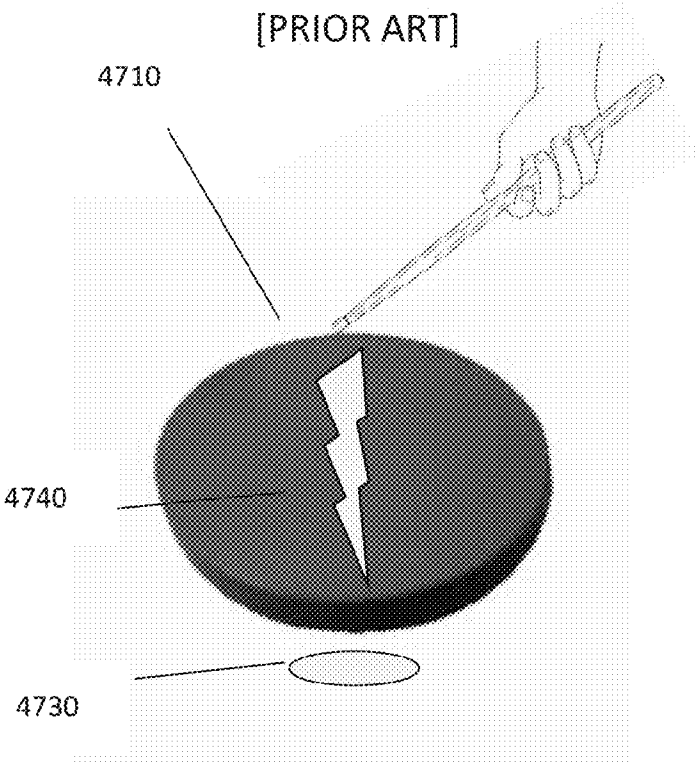
FIGS. 47A and 47B provide diagrams of prior art trigger configurations that utilize a foam block and a large rubber buffer respectively.
Figure 47A:
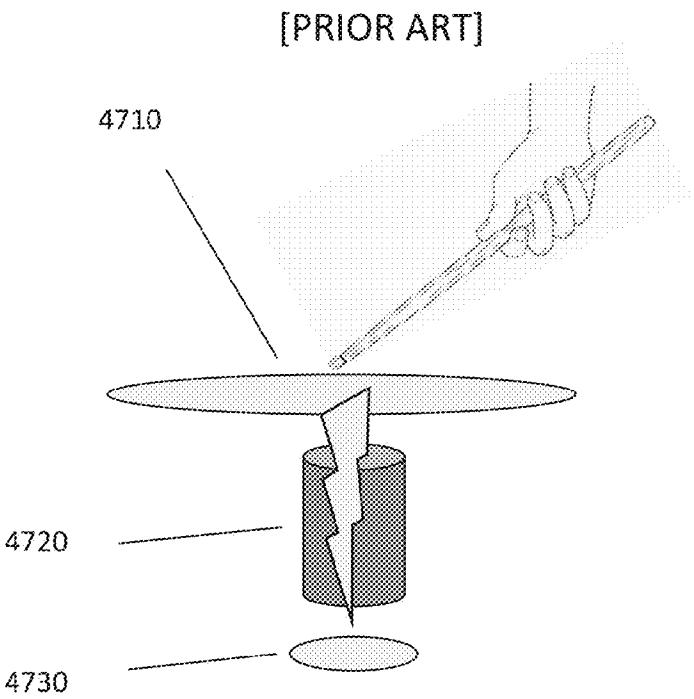
Figure 48A:
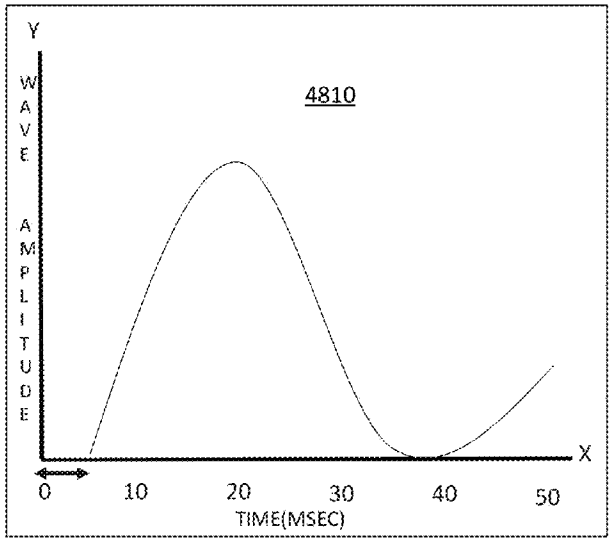
Fig 48A [PRIOR ART]

FIGS. 47A and 47B show prior art trigger setups on a drum head 4710. In FIG. 47A, a foam block 4720 is disposed between the prior art trigger 4730 and the drum head 4710, causing the attack or strike of the drum head 4710 to travel through the foam block 4720 before reaching the prior art trigger 4730. The density of the foam block 4720 results in the pickup lag illustrated in the initial gap before the waveform is detected in chart 4810 of FIG. 48A. The foam block 4720 also alters the waveform as it passes through the foam block 4720 as illustrated in chart 4820 of FIG. 48B. Chart 4820 also illustrates the reduction of the sharpness of the initial attack or attack dampening caused by the foam block 4720.

Figure 48B:
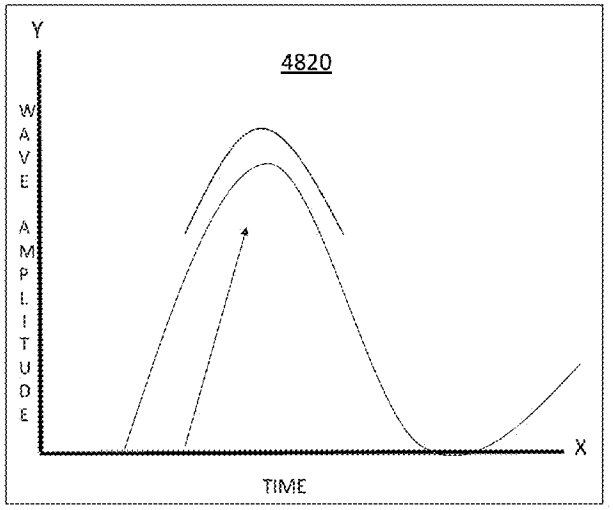
Fig 48B [PRIOR ART]
Figure 48C:
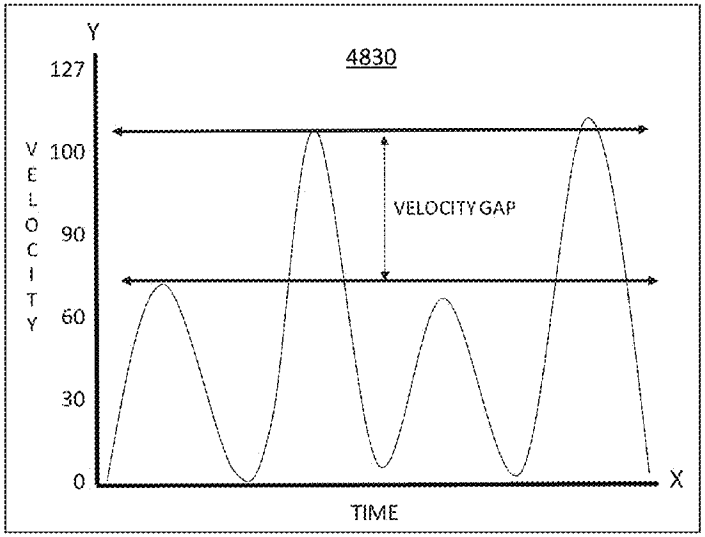
Fig 48C [PRIOR ART]

FIG. 48B illustrates a prior art configuration with a drum head 4710 with a rubber pad 4740 beneath the drum head 4710. The rubber pad 4740 causes a velocity gap or velocity gapping in the MIDI velocity scale output to the module 300 as shown in chart 4830 of FIG. 48C. In either setup shown in FIG. 47A or 47B, the initial strike will be less defined and the tapering of the waveform will be inconsistent as shown in chart 4900 of FIG. 49. The typical headroom in one of these two prior art trigger configurations increases re-triggering and relies on additional compensation by the drum module 300 to make up for the lack of accuracy of the prior art trigger.

Figure 49:
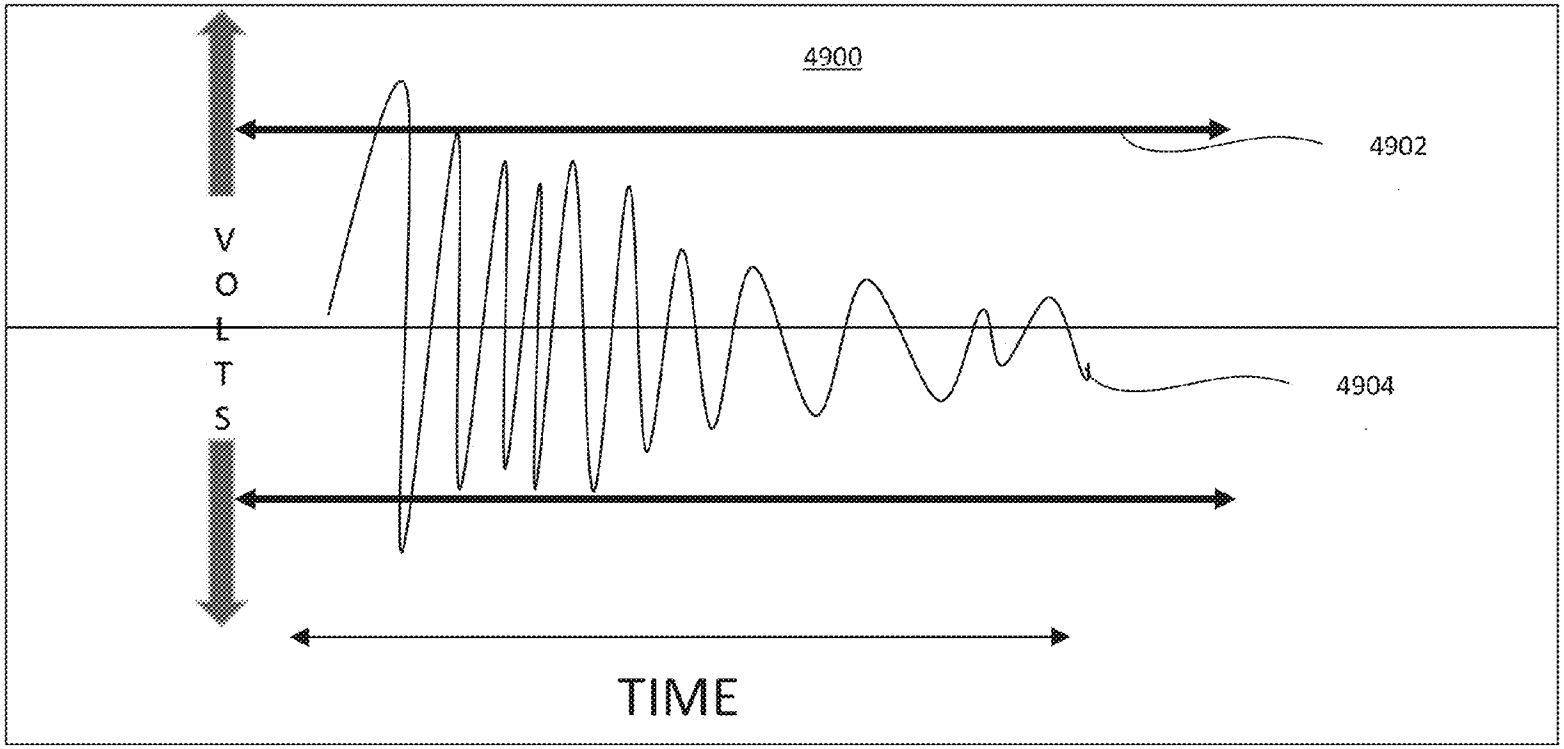

Comparing the waveform 4604 shown in chart 4600 of FIG. 46 produced by the trigger 100 of the present invention to a prior art trigger waveform shown in chart 4900 of FIG. 49 shows the difference in the amplitude and attenuation of the wave from the present invention 4604 and from the prior art 4904. The bars 4602 and 4902 represent module threshold settings which are functions of voltage output of a piezoelectric transducer/trigger. For example, in a drum module 300, shown in FIG. 3, configuration settings may need to be input to increase or reduce the threshold to stop instances of double triggering or non-triggering. The threshold 4902 for the prior art wave 4904 is much greater than the threshold 4602 for the present invention wave 4604. In one example, if the threshold 4602 were set to a setting of 1×, the threshold 4902 setting for the prior art drum trigger at the module 300 may have to be 5×, or 5 times greater than the setting used for the trigger 100 of the present invention. Secondary and unwanted triggering events caused by the waves occur when a portion of the waveform exceeds the threshold boundaries. The prior art wave 4904 can be seen coming near the threshold 4902 more closely and more frequently than in the wave 4604. Secondary artifacts in the wave 4604 are far enough from the initial strike and are attenuated enough such that the module 300 does not need to be adjusted for settings such as threshold and scan time to compensate for large secondary artifacts and slow attenuation that occur in the wave 4904.

Figure 50:
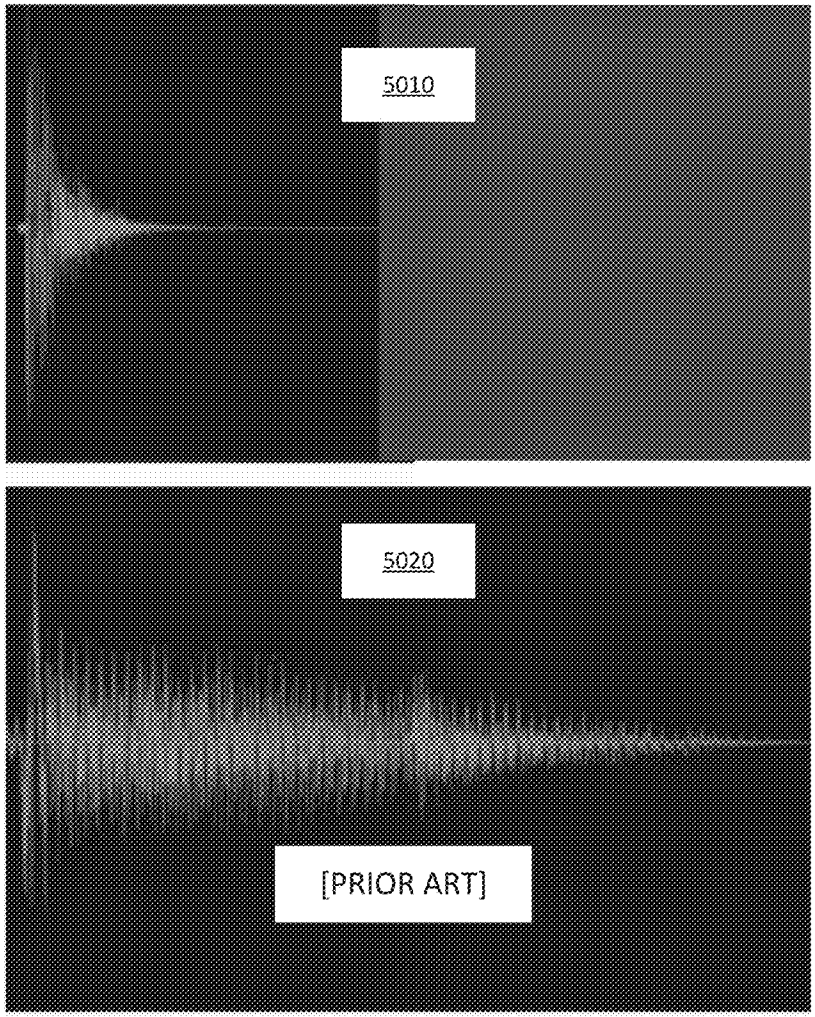
Figure 51:
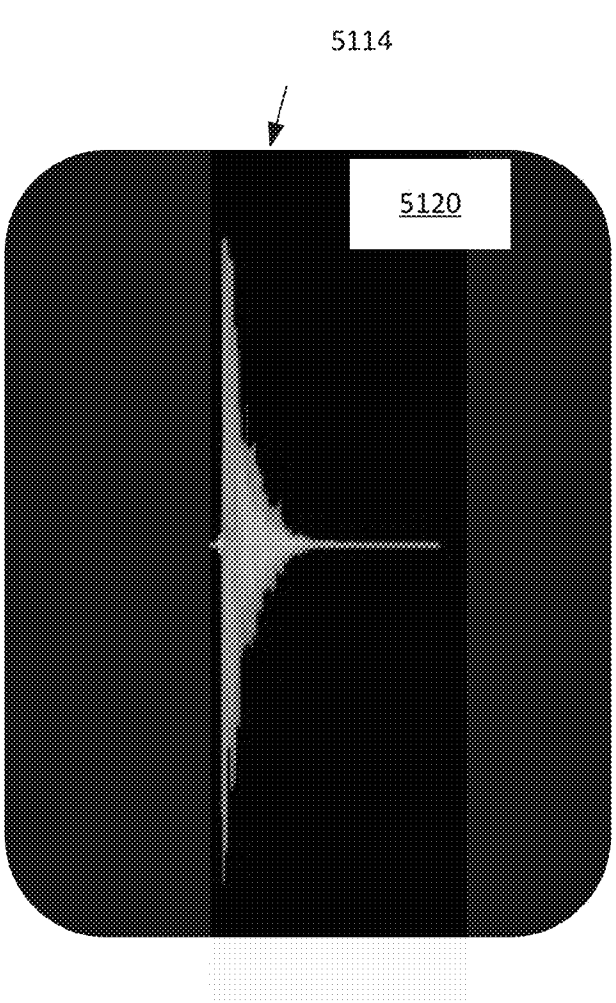
Figure 51:
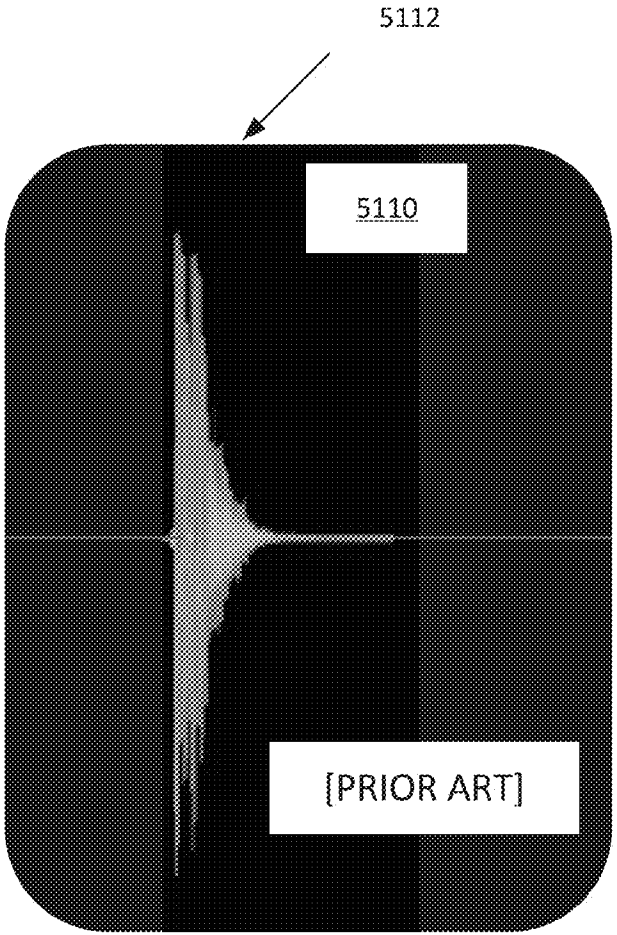

FIGS. 50 and 51 more clearly illustrate the difference between a waveform captured by the trigger 100 of the present invention and prior art trigger configuration. The waveforms 5010 and 5120 illustrate waveforms captured by a trigger 100 of the present invention on a 13" snare drum. The waveforms 5020 and 5110 illustrate waveforms captured by a prior art tension arm trigger configuration on the same 13" snare drum. It is clearly shown in FIGS. 50 and 51 that the prior art trigger's captured waveform is longer, less attenuated, and less clear on the initial attack with a second large wave spike that could cause a double-triggering event. Also, as shown in FIG. 51, the prior art trigger may capture a second triggering event after the initial attack. This may be caused by the prior art trigger physically leaving contact with the drum head, or may be caused by the manner in which the prior art trigger is secured to the drum head. In either instance, the prior art tension arm trigger does not register a single, clear attack with a clear attenuation of the waveform following the initial drum strike. The trigger 100 of the present invention captures a single, clear attack without a second large spike that would cause another triggering event.

Figure 2:
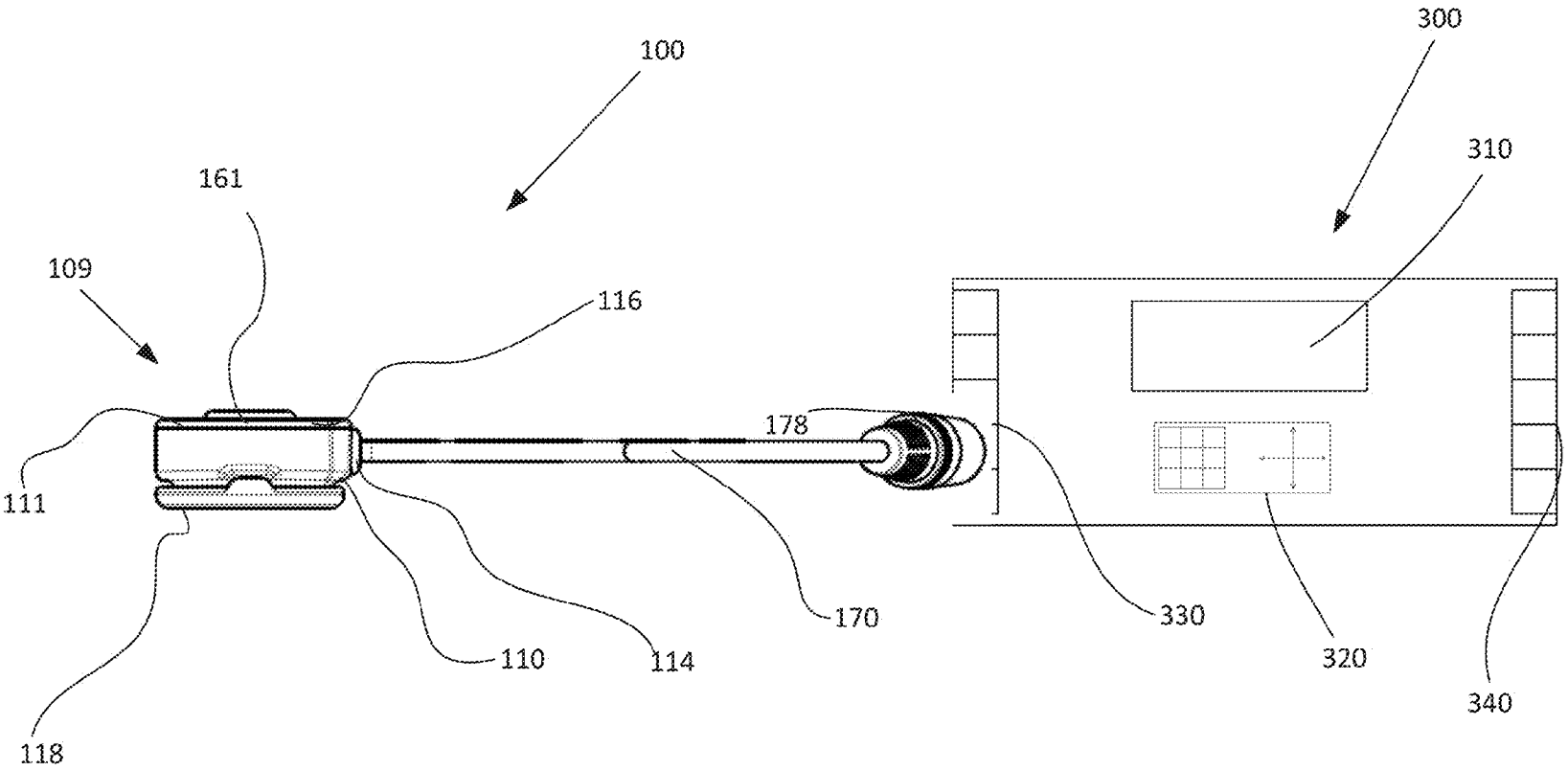
FIG. 2 provides a perspective view of a trigger according to the present invention.

With reference now to FIG. 2, a perspective view of a trigger 100 according to the present invention is provided. The trigger 100 comprises the housing 109, comprising the housing body 110 and magnet plug 111 which has a grommet 161 disposed in the top of the magnet plug 111. In this embodiment of the trigger 100, shown in greater detail in FIGS. 4-6, 9B, and 10-14, the housing body 110 holds the piezoelectric transducer 140 and the magnet 120 is held between the housing body 110 and the magnet plug 111. The trigger 100 therefore comprises a two-piece shell with the primary component of the shell being the housing body 110 and the secondary component of the shell being magnet plug 111. The pass-through opening 114 is adapted to permit an electrical lead 170 to pass through the pass-through opening 114. The electrical lead 170 may have a tip-ring-sleeve (TRS) jack, XLR connector, or other suitable connector at the termination 178 of the electrical lead 170. The termination 170 is adapted to operatively connect to an electronic module 300, which may be a drum module or other suitable audio module. A list of exemplary drum module with links to their descriptions and methods of operation is provided in Table 1, and all descriptions are incorporated herein by reference in their entirety. Additionally, descriptions of electronic drum modules can be found in Wikipedia articles entitled "Roland V-Drums", https://en.wikipedia.org/wiki/Roland_V-Drums, and "Electronic Drum", https://en.wikipedia.org/wiki/Electronic_Drum, both of which are incorporated herein in their entirety.

| BRAND | MODULE | Information |
|---|---|---|
| ROLAND | TD-30 | http://www.rolandus.com/products/td-30/ |
| ROLAND | TD-25 | http://www.rolandus.com/products/td-25/ |
| ROLAND | TD-15 | http://www.rolandus.com/products/td-15/ |
| ROLAND | TD-11 | http://www.rolandus.com/products/td-11/ |
| ROLAND | TM-2 | http://www.rolandus.com/products/tm-2/ |
| ALESIS | DM-10 | http://www.alesis.com/dm10prokit |
| ALESIS | DM-8 | http://www.alesis.com/dm8prokit |
| 2BOX | DRUMMIT 5 | http://www.2box.se/US/pages/products/ |
| YAMAHA | 502 SERIES | http://usa.yamaha.com/ |
| YAMAHA | DTX950K | http://usa.yamaha.com/ |

A drum module 300 may have a display 310, set of controls 320, a set of inputs 330, and a set of outputs 340. The trigger 100 is adapted to connect to the module 300 by way of the electronic lead 170 to an input 330. Configuring the drum module is performed by manipulating the inputs 320 and using the display 310 to view the current configuration and options for the module 310. The module 300 may be connected to additional equipment such as speakers, computers, amplifiers, and additional electronic modules by way of outputs 340 which may comprise universal serial bus (USB) ports, TRS receptacles, XLR female receptacles, RJ-45 jacks, or other suitable connections.

In typical operation, a mechanical signal, e.g. a strike of a drum head or drum shell, is translated by the piezoelectric transducer 140 in the trigger 100 into an electrical signal. This electrical signal may comprise a level which may fall on a range of 127 or more levels. This signal is received by the module 300 and the module 300 determines how to interpret the signal. For example, if the trigger 100 is disposed on a drum, and the signal is an electrical representation of the strike of a drum, the module 300 may determine which sound from a library of sounds to output to the outputs 340. The module 300 may also make this determination based on a set of settings used to configure the module. The set of settings may be selected from a library of configurations or settings stored in or loaded onto the module 300. The module 300 may be manipulated by the inputs 320 to fine tune the module to the particular implementation of the trigger 100. These fine tunings may be used to employ a plurality of triggers 100 on a single instrument. The trigger 100 is adapted to be used with a plurality of other triggers 100 to create a set of "zones" on an instrument, e.g. a drum. The trigger 100 does not receive cross-talk interference from other triggers like trigger 100 used on the same instrument, and when used as a set of triggers 100, does not suffer from "hot-spotting" which is the higher sensitivity of particular areas on an instrument such as a drum.

Figure 4:
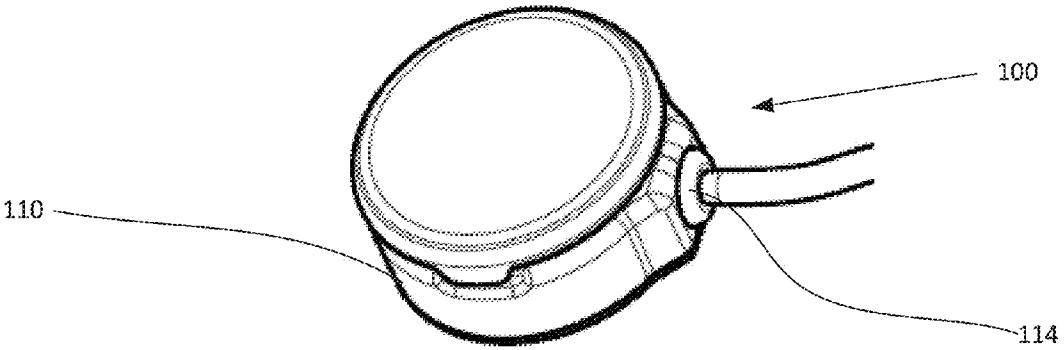

With reference now to FIGS. 3 and 4, side and rear views respectively of a trigger 100 with a strain relief sleeve 174 according to the present invention are provided. The electrical lead 170 extending from the housing body 110 of the trigger 100 may be bent at various angles depending on the implementation of the trigger 100. It may therefore be necessary to employ a form of strain relief such as strain relief sleeve 174 to prevent kinking, fraying, or damage to the electrical lead 174. The strain relief sleeve 174 may be attached to the opening 114 which may be modified to accommodate the shape of the strain relief sleeve 174.

Figure 5:
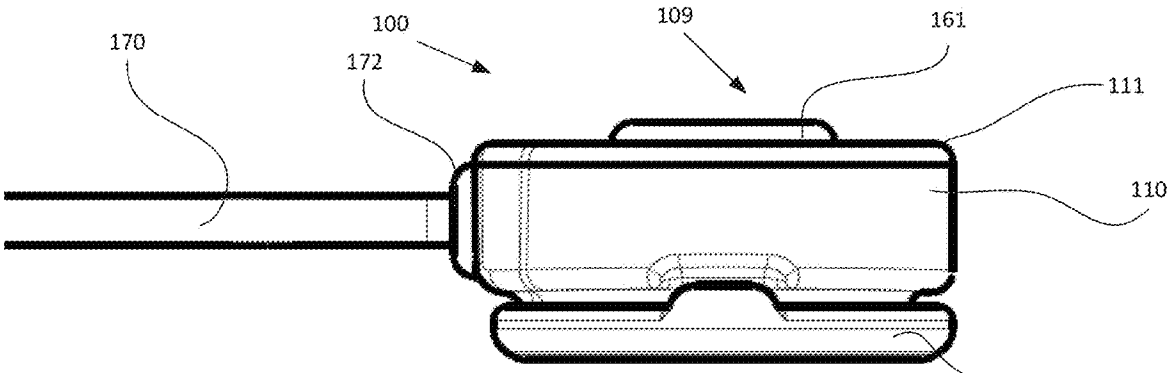
FIGS. 5 and 6 provide side and top views respectively of a trigger with electrical lead according to the present invention.
Figure 6:
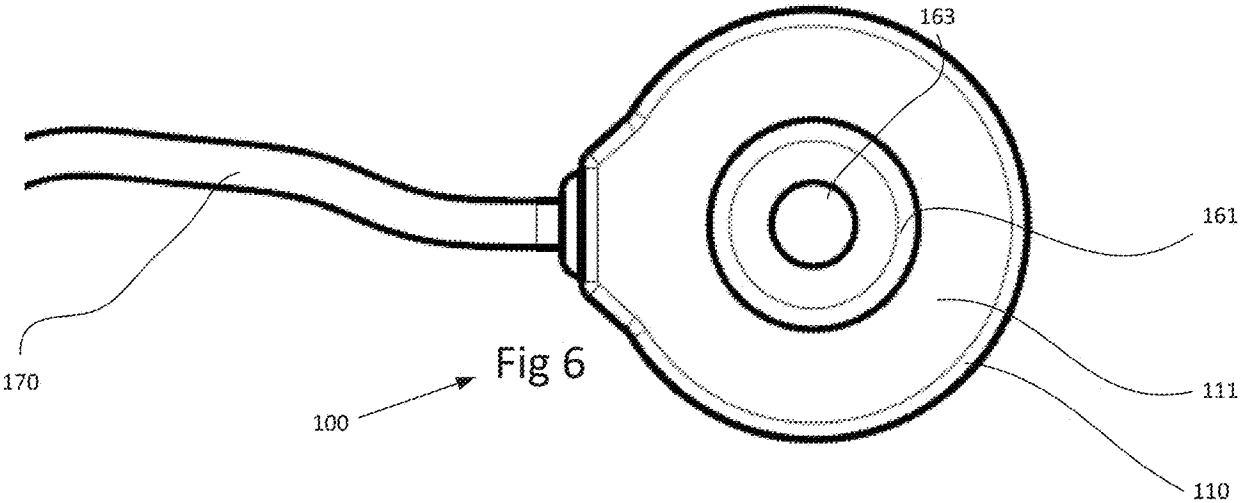

With reference now to FIGS. 5 and 6, side and perspective views respectively of a trigger 100 with electrical lead 170 according to the present invention are provided. The trigger 100 is shown with the electrical lead 170 extending from the housing body 110 of the trigger 100. Electrical lead 170 may comprise a set of two or more wires 172 that connect to electrical connections 146 on the piezoelectric transducer 140 as shown in FIGS. 14 and 15. The grommet is disposed at the top 116 of the trigger 100 and has an opening 162 in the center of the grommet 161 adapted to receive a lug or other suitable mounting protrusion. The silicone buffer layer 150 is disposed at the bottom 118 of the housing body 110 of the housing 109 and serves as a physical buffer for any vibrations or impacts and also serves to help secure and stabilize the trigger 100. An additional buffer layer may be used in some embodiments to provide additional protection to the trigger 100 when attached to a lug on the grommet 161 side of the trigger 100.

Figure 7:
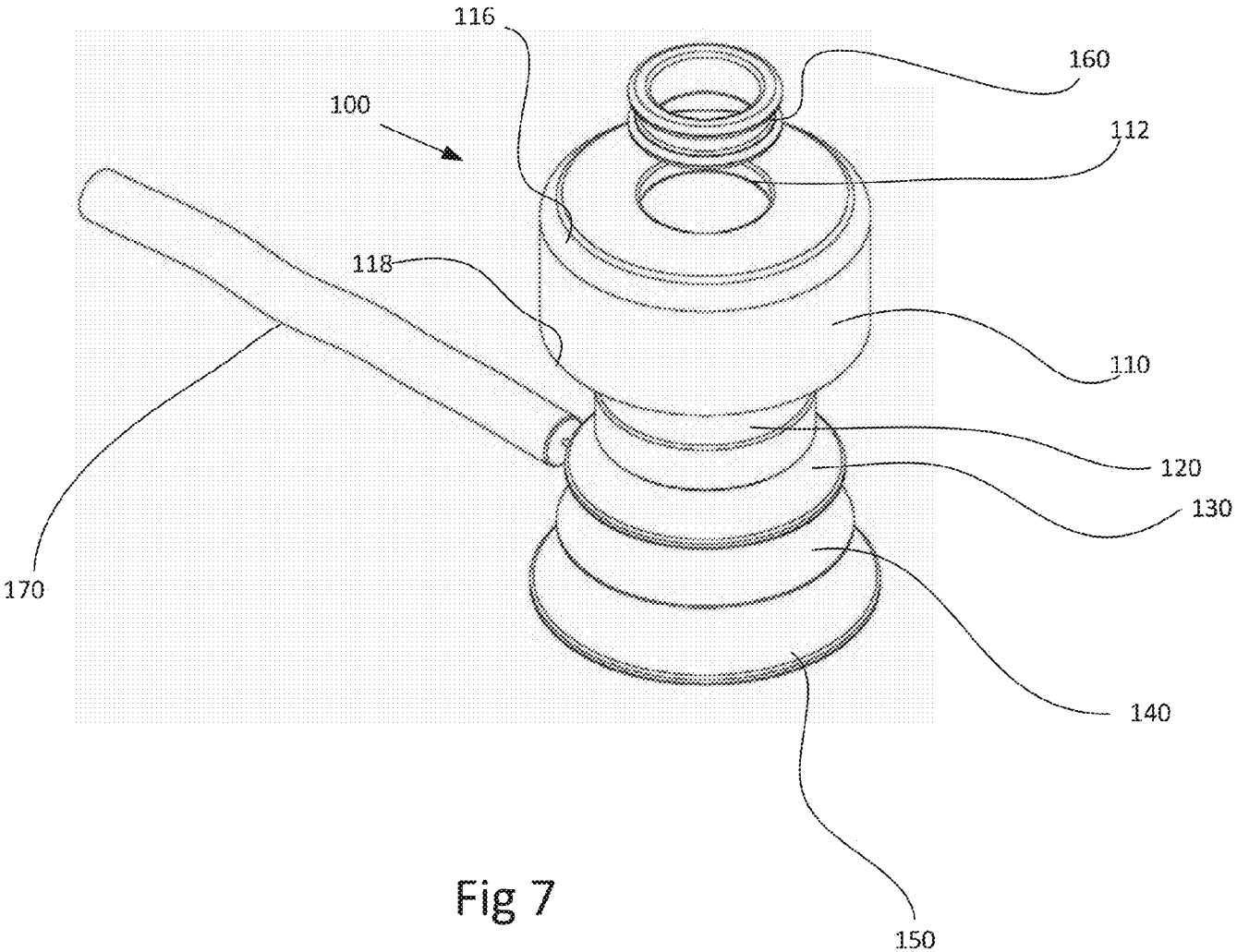
FIG. 7 provides a perspective view of a trigger showing the trigger components according to the present invention.
Figure 8:
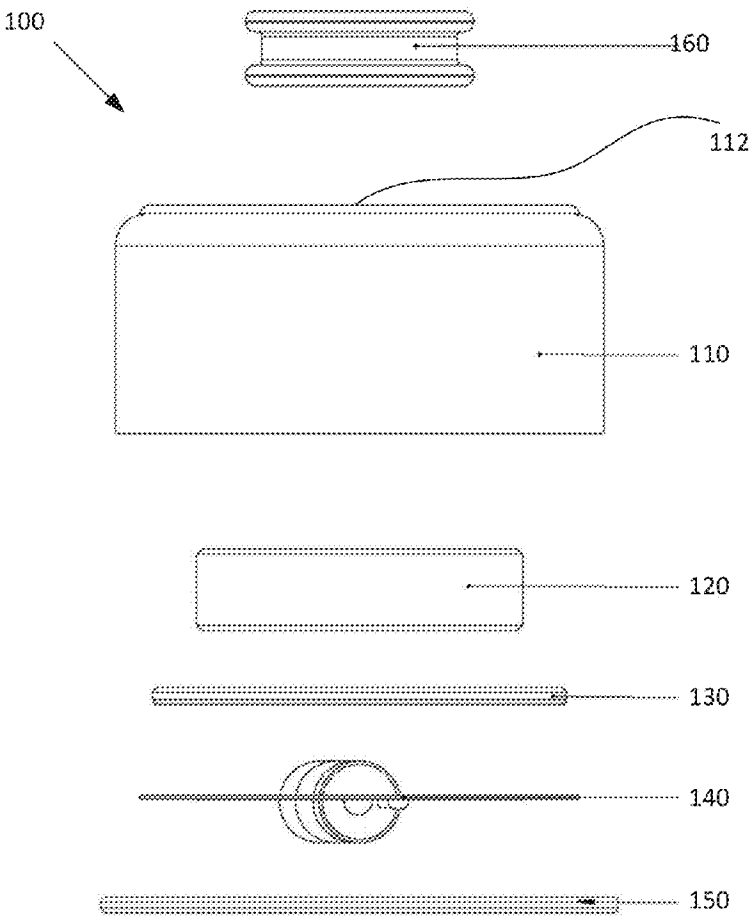
FIG. 8 provides a side view showing the components of a trigger according to the present invention.

With reference now to FIG. 7 a perspective view of an alternate embodiment of trigger 100 showing the trigger 100 components according to the present invention is provided. FIG. 7 provides an "expanded" or "exploded" view of the components of the trigger 100, showing the order in which the components may be disposed within the housing 110. The grommet may be disposed in the opening 112 at the top 116 of the housing 110. Within the housing 110, the magnet 120 may be secured to the interior of the top 116 of the housing body 110 by way of an adhesive. The silicone buffer layer 130 may be secured to and disposed on the magnet 120 within the housing. The piezoelectric transducer 140 is disposed at the bottom 118 of the housing body 110 and may be placed in a lip or groove at the bottom of the housing 110. The electrical lead 170 passes through the pass-through opening 114 in the housing body 110 to connect to the piezoelectric transducer 140. The silicone buffer layer 150 may be disposed on the bottom 118 of the housing body 110 to provide protection to the piezoelectric transducer 140. FIG. 8 provide a side view of the trigger 100 showing the components described with respect to FIG. 7. The housing body 110 may have a diameter of 30 mm, a bottom 118 with an opening of 27 mm, giving the housing body 110 a thickness of 1.5 mm. The housing body 110 may be 13.95 mm tall. The opening 112 may be 12 mm in diameter. The pass-through opening may be 5 mm in diameter and the middle of the pass-through opening 114 may be 3.2 mm from the bottom 118 of the housing 110.

Figure 9B:
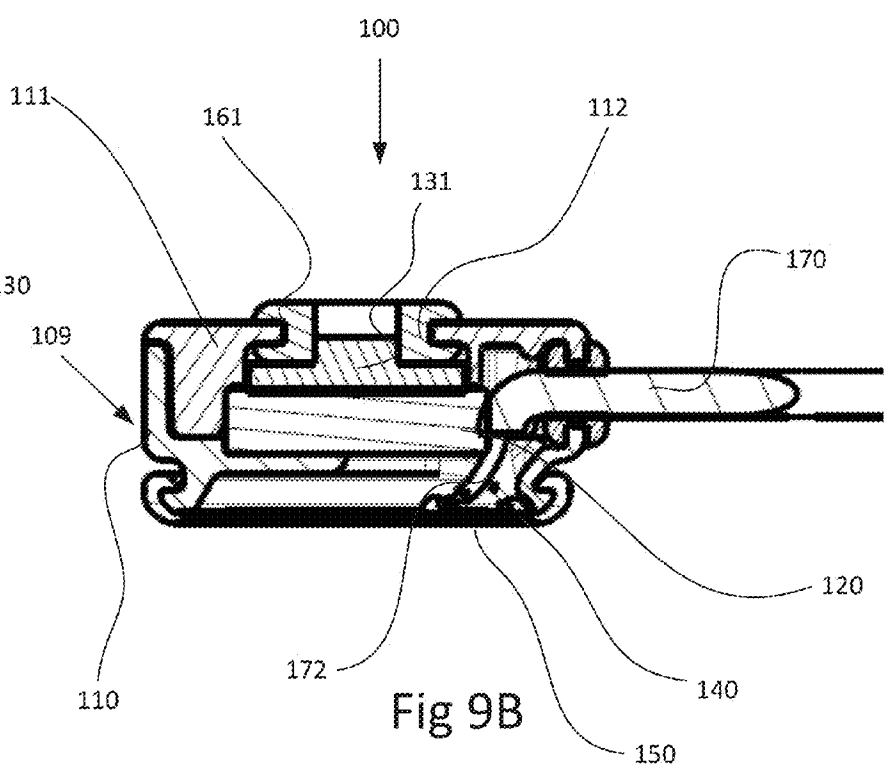
FIG. 9B provides a side cross-section view of a trigger according to the present invention.
Figure 9A:
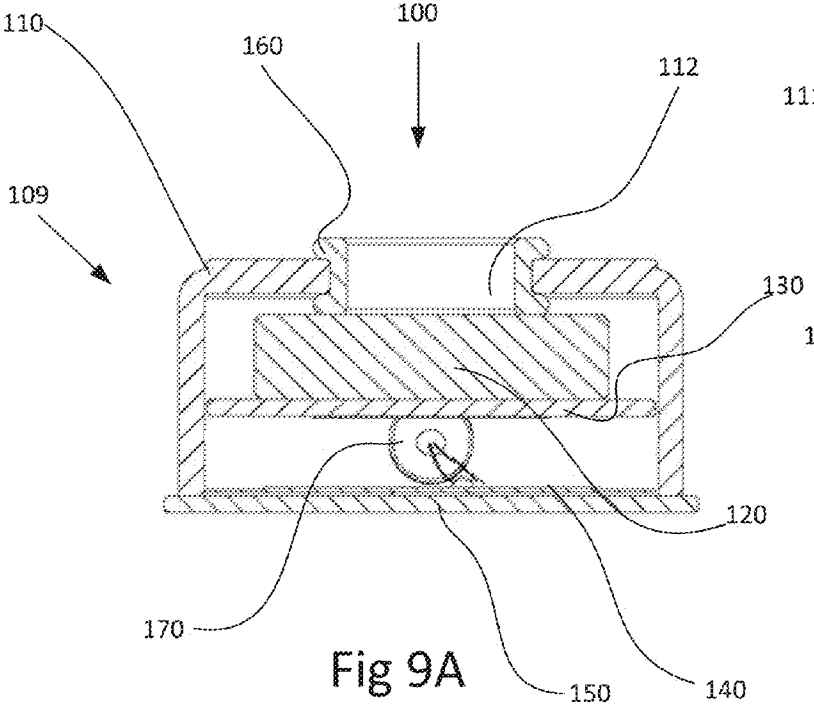
FIG. 9A provides a side cross-section view of a trigger according to the present invention.

With respect to FIG. 9A, a side view showing an alternate embodiment of the components of a trigger 100 according to the present invention is provided. In this embodiment, the silicone buffer layer 130 is disposed between the magnet 120 and the interior of housing body 110 of housing 109. This may be to prevent movement of the magnet 120 and to provide protection to the interior of the housing body 110 when the trigger 100 is employed primarily in a grommet 160 attachment configuration. The piezoelectric transducer 140 may be disposed within the housing body 110 as shown, but in most implementations is optimally disposed at the bottom 118 of the housing body 110 abutting the silicone buffer layer 150.

With reference now to FIG. 9B a side cross-section view of a trigger according to the present invention is provided. In FIG. 9B the trigger is primarily comprised of a housing 109 comprising housing body 110 and magnet plug 111. The magnet plug 111 secures the magnet 120 between the magnet plug 111 and the housing 110. A grommet 161 fits in the opening in the magnet plug 111 and an adapter post 131 fits in the grommet 161 and keeps the magnet 120 secure within the housing body 110 and magnet plug 111. The piezoelectric transducer 140 is secured in the housing body 110 by the silicone buffer layer 150 that is disposed on the bottom of the housing body 110 and is secured to the outer lip 1002, shown in FIG. 10. The wires 172 connect the piezoelectric transducer 140 to the electrical lead 170 and are routed through the housing interior opening 1006 shown in FIG. 11. A space 1005 behind the piezoelectric transducer 140 enables the transducer 140 to flex within the housing 110. This flexing is critical to accurately capturing both the velocity and tone of an instrument, e.g. the strike of a drum. The manner in which the trigger 100 is disposed on a drum head such as drum head 2400 shown in FIG. 24, using the securing device 200 enables the trigger to move with the drum head 2400 and more quickly return to a steady state wherein the voltage produced by the piezoelectric transducer 140 is below a threshold that would cause a triggering event in a module such as module 300.

Figure 11:
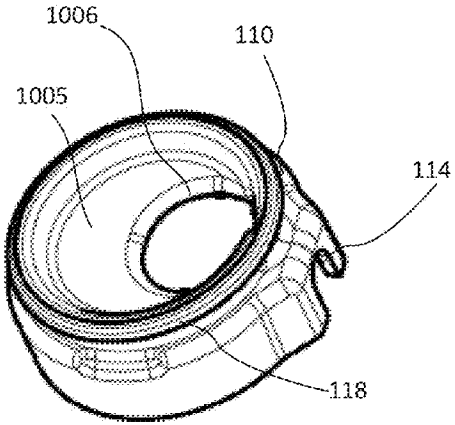
FIGS. 10, 11, 12, and 13 provide side cross-section and top perspective views of a trigger housing and magnet plug according to the present invention.
Figure 13:
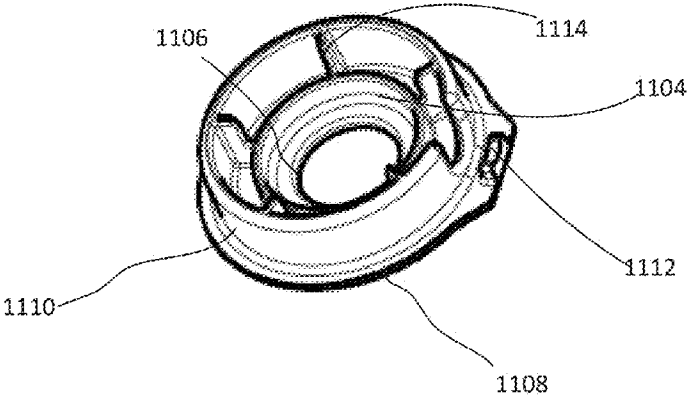
Figure 10:
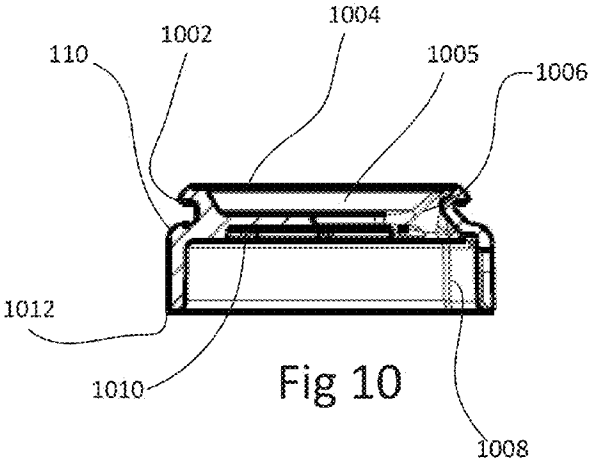
Figure 12:
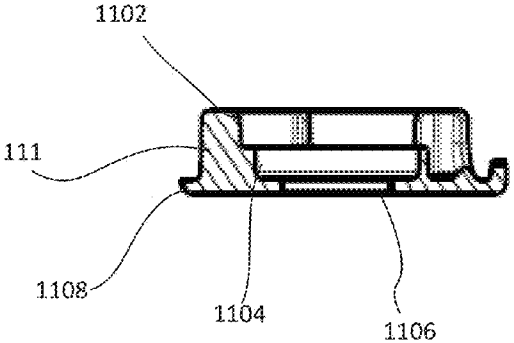

With reference now to FIGS. 10, 11, 12, and 13, side cross-section and top perspective views of a trigger housing body 110 and magnet plug 111 according to the present invention are provided. FIGS. 10 and 11 show the housing 110, and FIGS. 12 and 13 show the magnet plug 111. The housing body 110 has an outer lip 1002 at the bottom 118, an inner lip 1004, an interior opening 1006, an inner area 1008, and a magnet seat 1010. The piezoelectric transducer 140 is disposed in the inner lip 1004 and is held in place and protected by the silicone buffer layer 150 that is disposed on the bottom 118 and secures over the outer lip 1002. A set of wires 172 connect the piezoelectric transducer 140 to the electrical lead 170 and feed through the interior opening 1006 to the pass-through opening 114. The chamber 1005 provides space for the piezoelectric transducer 140 to vibrate so that it can accurately capture analog signals from a drum head or other musical instrument. The magnet plug 111 is adapted to fit within the plug opening 1008 of the housing 110. The magnet 120 sits within the magnet opening 1102 of the magnet plug 111 and is also received by the magnet opening 1010 of the housing 110. The adapter post 131 is disposed within the adapter opening 1104 and serves as a buffer between the magnet 120 and the grommet 160. The grommet 160 is disposed within the grommet opening 1106 of the magnet plug 111. The magnet plug lip 1108 abuts the housing top 1012 when the magnet plug 111 is disposed within the housing 110. A set of stabilizing posts 1114 within the magnet plug 111 hold the magnet 120 within the magnet plug 111.

Figure 14B:
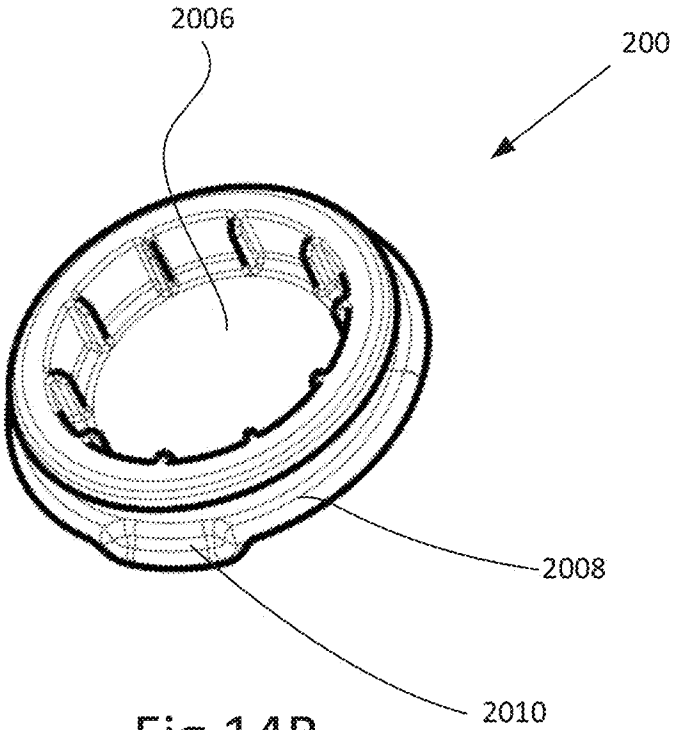
FIGS. 14A and 14B provide side cross-section and top perspective views of a securing device according to the present invention.
Figure 14A:
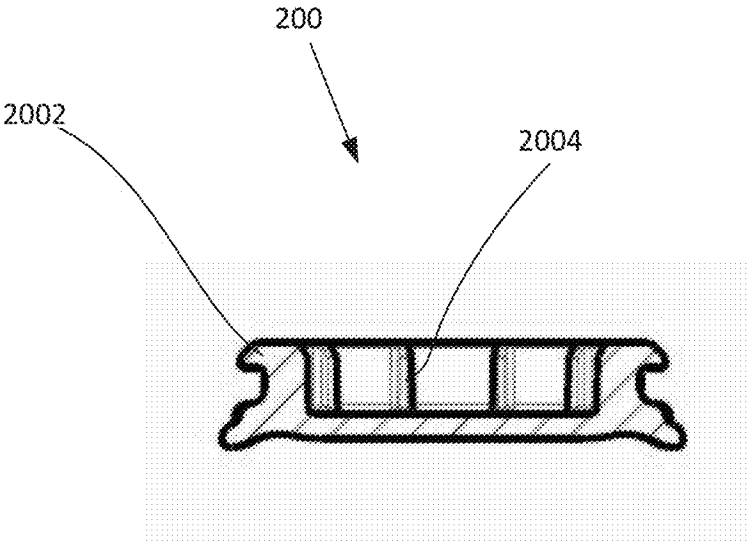

With reference now to FIGS. 14A and 14B, side cross-section and top perspective views of a securing device according to the present invention are provided. The securing device 200 secures the trigger 100 to a drum head or other musical instrument. The outer lip 2002 of the securing device 200 is adapted to secure a silicone buffer such as the buffer 150 shown in FIGS. 16 and 17. A magnet such as magnet 120 would be disposed in the interior 2006 of the securing device 200 and a set of stabilizing posts 2004 would secure the magnet in place. A tab 2010 on the bottom lip 2008 enables the securing device 200 to be easily removed from a surface on which it is placed.

Figures 15A, 15B:
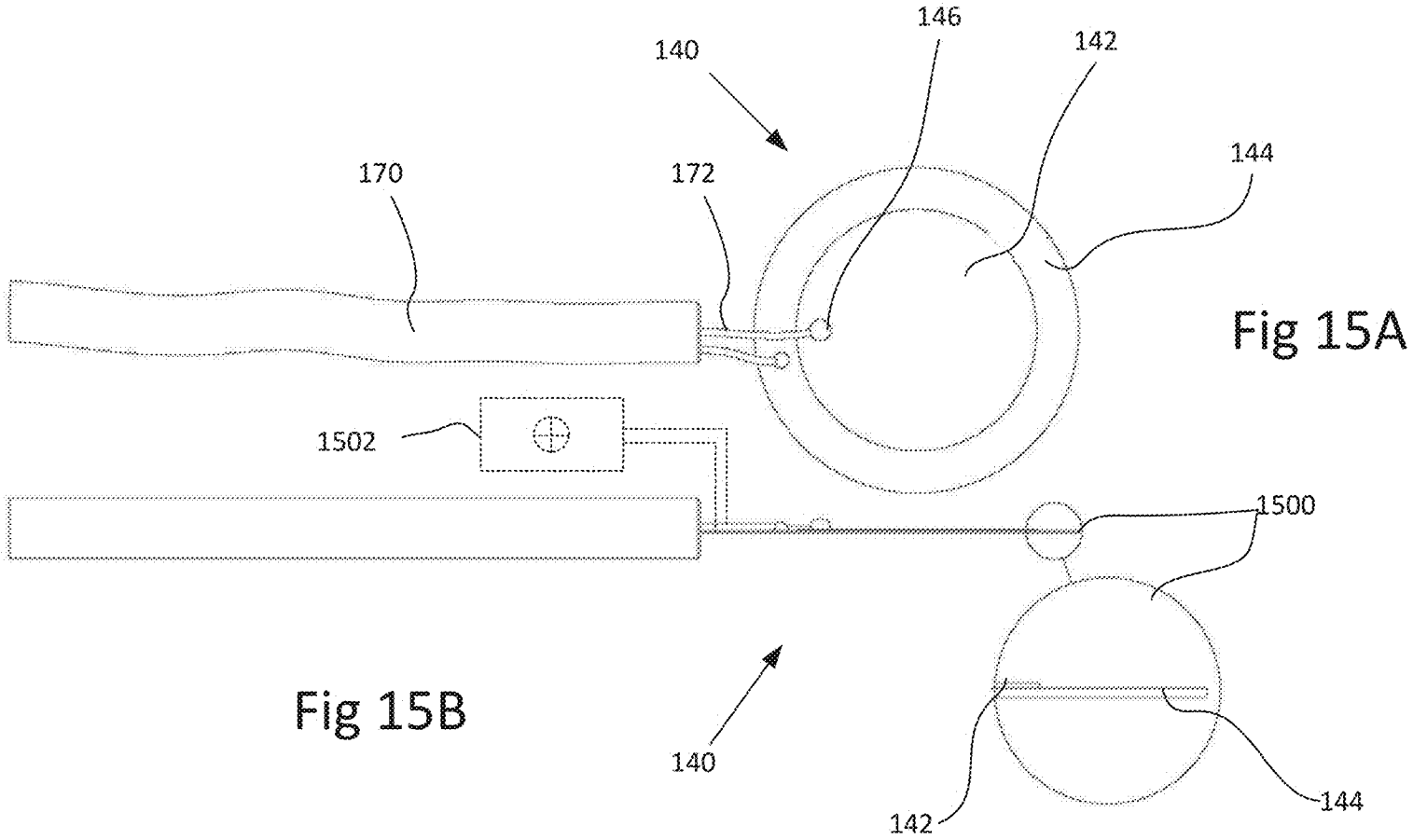
FIGS. 15A and 15B provide plan and side views respectively of a piezoelectric transducer according to the present invention.
Figure 23:
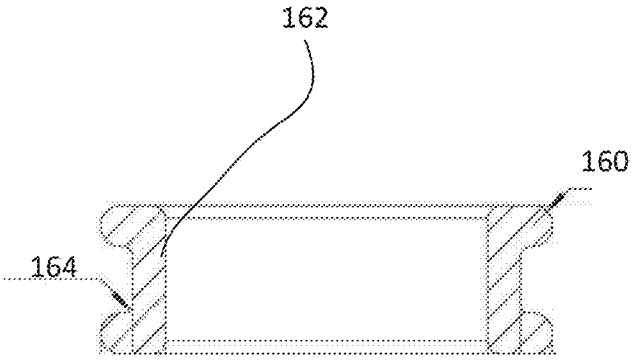
FIGS. 22, 22A, 23 and 23A provide side and cross-section views respectively of separate embodiments of grommets according to the present invention.
Figure 23A:
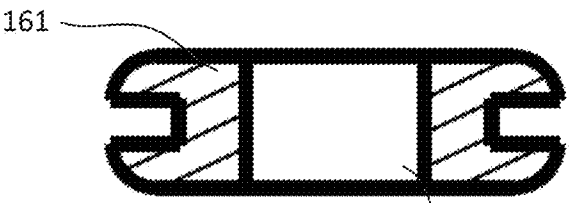
Figure 22:
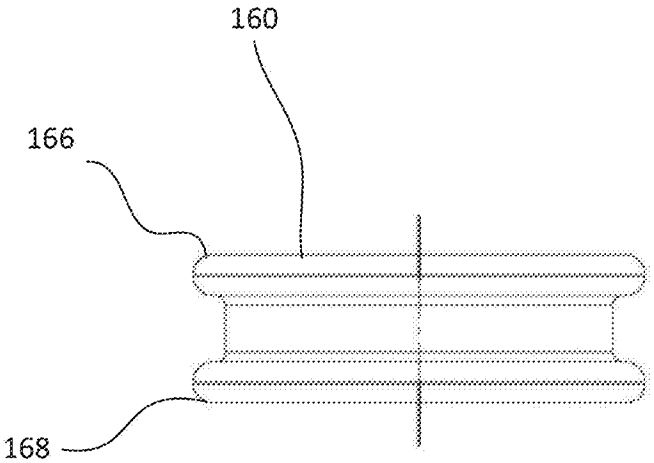
Figure 22A:
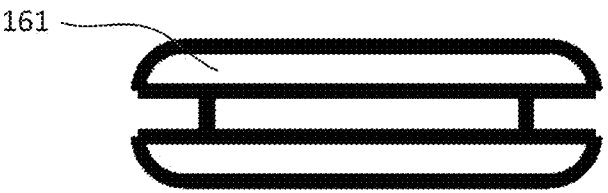

With reference now to FIGS. 15A and 15B, plan and side views respectively of a piezoelectric transducer 140 according to the present invention are provided. In FIG. 14, the electrical lead 170 with set of wires 172 is shown electrically and operatively connected to electrical connections 146 on the bottom portion 144 and top portion 142 of the piezoelectric transducer 140. The top portion 142 may be comprised of ceramic or other suitable material and the bottom 144 may be comprised of brass or bronze or other suitable non-magnetic metal. The material used for the bottom 144 must not be magnetically attractive or the magnet 120 used in the trigger 100 may interfere with the operation of the piezoelectric transducer 140. The inset 1500 shown in FIG. 15 shown the detail of the thickness of the top portion 142 and bottom portion 144 of the piezoelectric transducer 140. The top portion 142 may a have a diameter of 20 mm and be 0.1 mm thick, and the bottom portion may have a diameter of 27 mm and be 0.2 mm thick. When used in a housing such as housing body 110 or housing 111, shown in FIGS. 13A and 13B, the piezoelectric transducer needs to be able to bend and flex to accurately transducer the mechanical inputs into electrical signals. The buffer layers such as layers 130 and 150 shown in FIG. 1 isolate the piezoelectric transducer from the magnet and the surface on which the trigger 100 is placed, but still place the piezoelectric transducer 140 in physical abutment with the surface. Additionally, a potentiometer 1502 may be attached to the wires 172 to enable the output of the piezoelectric transducer 140 to be more finely tuned by adding additional resistance to lower the voltage output.

With reference now to FIGS. 16 and 17, side and plan views respectively of an exterior silicone buffer layer 150 according to the present invention are provided. The silicone buffer layer 150 may be 31.75 mm in diameter and may be 1 mm thick. The silicone buffer layer 150 is adapted to fit over the lip 1002 of the housing body 110 and the out lip 2002 of the securing device 200. A tab 151 on the silicone buffer layer 150 enables the buffer layer 150 to be removed once installed such that the buffer layer 150 may be replaced or so that the piezoelectric transducer 140 under the buffer layer 150 may be accessed.

With reference now to FIGS. 18 and 19, side and plan views respectively of a trigger magnet 120 according to the present invention are provided. The magnet 120 may be composed of neodymium or other suitable rare earth magnets. For example, the trigger magnet may be from the group consisting of neodymium-based rare earth magnet, ceramic composite, ferrite composite, barium or strontium carbonate, iron-oxide composite, samarium cobalt, neodymium iron boron. The magnet 120 may be 5 mm thick and may be 20 mm in diameter.

With reference now to FIGS. 20 and 21, side and plan views respectively of an adapter post 131 according to the present invention are provided. The adapter post 131 is disposed within the interior of the trigger 100 between the magnet 120 and the magnet plug 111. The protrusion 133 of the adapter post 131 fits within the interior 163 of the grommet 161.

With reference now to FIGS. 22, 22A, 23 and 23A, side and cross-section views respectively of a grommet 160 and grommet 161 according to the present invention are provided. The grommet 160 may be 14 mm wide, have a thickness of 2 mm at the top 166 and bottom 168, and a thickness of 1 mm at the groove 164. The interior opening of the grommet 160 may be 10 mm wide. The grommet 160 may be 5 mm tall and the groove 164 may be 2.05 mm tall, and each of the top 166 and bottom 168 may be 0.6 mm tall. The grommet 161 is an alternate embodiment of the grommet 160 and is adapted to fit within the magnet plug 111 instead of the housing 110.

Figure 24:
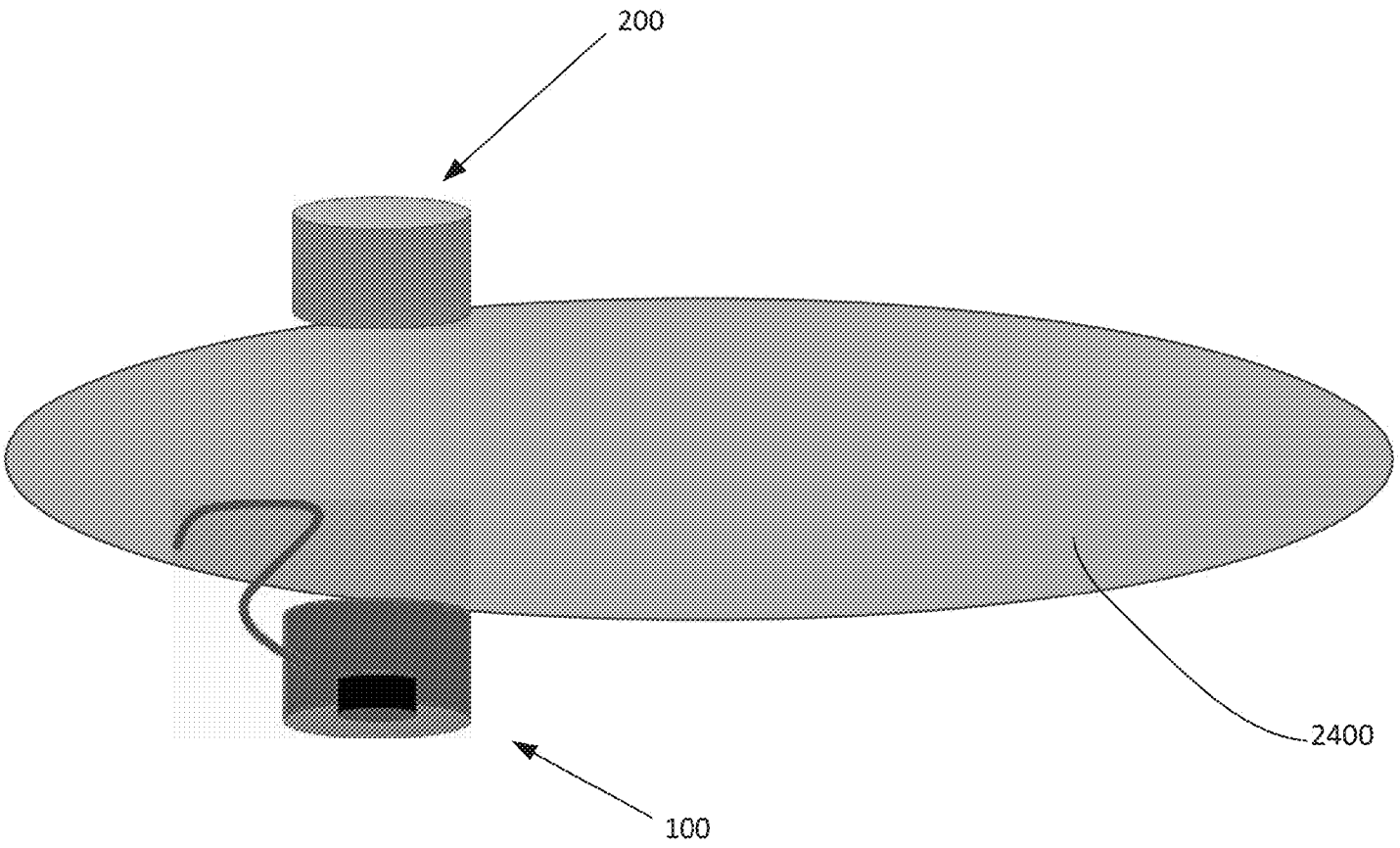
FIG. 24 provides a diagram showing a trigger and securing device being attached to a drum head according to the present invention.

With reference now to FIG. 24, a diagram showing a trigger 100 and securing device 200 being placed on a drum head 2400 in a "Thru-Head" configuration according to the present invention is provided. In this configuration, the securing device 200 and trigger are configured to straddle the drumhead 2400. This enables the trigger 100 to be installed on most drum head with minimal effort and without using adhesives, glues, putties, or other potentially destructive or damaging securing methods. The drum head 2400 may be for an acoustic or electric drum and may comprise an acoustic drum head, single layer mesh head, or multiple layer mesh head. In a preferred configuration, the trigger 100 is used with a mesh drum head 2400 to accurately replicate the feel of playing on an acoustic drum head while reducing the noise produced when playing. A mesh head 2400 would also be variably adjustable for a desired tension compared to a multi-ply drum head. Using the trigger 100 as shown in FIGS. 24-35 enables the trigger 100 to accurately pick up the mechanical movement of the instrument and transmit the mechanical movement as an electrical signal. The trigger 100 used in this manner has only a 20% signal loss compared to a 60% or greater loss of traditional drum triggers. The trigger 100 records a sharp "attack", an input having an immediate spike and sharp drop off, of a drum strike compared to traditional drum triggers and also accurately can read and transmit 127 midi levels of input. Additional triggers 100 may be placed on the drum head 2400 and if multiple triggers 100 were used the triggers 100 would not "hot-spot" and would not experience crosstalk interference.

With reference to FIGS. 25, 26, 27, and 28, diagrams of a trigger 100 disposed on a drum lug 2522 in a drum shell 2500 in a "Thru-Lug" configuration according to the present invention is provided. The drum shell 2500 may have a plurality of tensioners 2520 attached to the exterior of the shell 2500 by a number of lugs 2522 disposed on the interior 2510 of the shell 2500. The grommet 160 of the trigger 100 is adapted to fit over a lug 2522, and the magnet 120 within the trigger 100 is magnetically attracted to the lug 2522. The trigger 100 is thereby magnetically and releaseably secured to the lug 2522. In this configuration, vibrations from striking a drum head or the drum shell 2500 are transmitted through the tensioner 2520 and lug 2522 to the trigger 100. This implementation of the trigger 100 may be preferred when the use of an external securing device 200 is not desired in order to maintain the "look" of the drum shell 2500, especially when used with acoustic drums.

Figure 29:
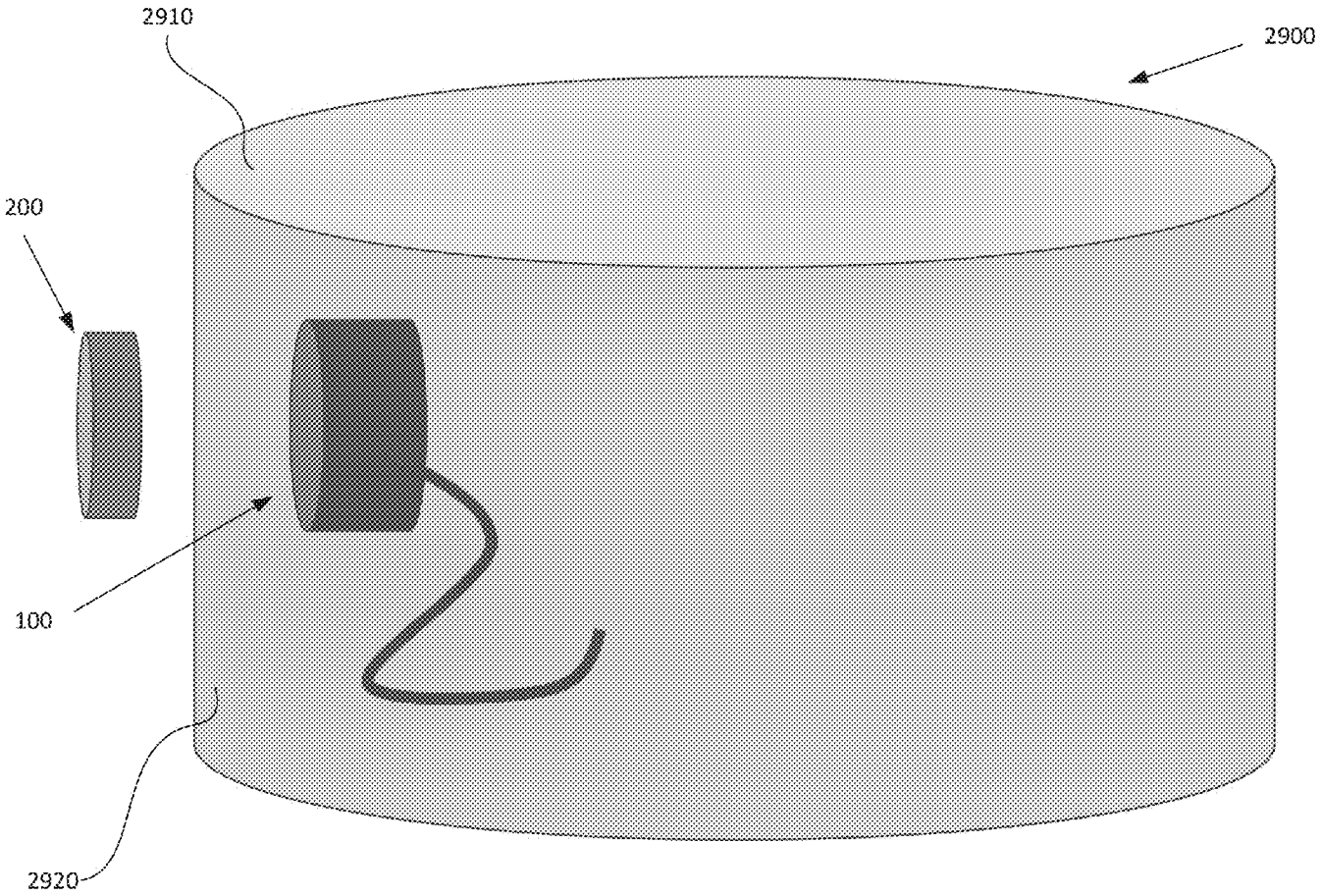
FIG. 29 provides a diagram of a trigger secured to a drum shell by a securing device according to the present invention.

With reference to FIG. 29, a diagram of a trigger 100 secured to a drum shell 2900 by a securing device 200 in a "Thru-Shell" configuration according to the present invention is provided. The securing device 200 is positioned on the exterior 2520 of the shell 2900 and the trigger 100 is disposed on the interior 2910 of the shell 2500 opposite the securing device 200. Magnets in one or both of the securing device 200 and trigger 100 magnetically and releaseably secure the trigger 100 to the shell 2900. In this configuration, vibrations from striking a drum head or the drum shell 2900 are transmitted through shell 2900 to the trigger 100. The trigger 100 configurations shown in FIGS. 24-29 may be used in conjunction with one another to enable triggering on more than one area of the drum.

Figure 30:
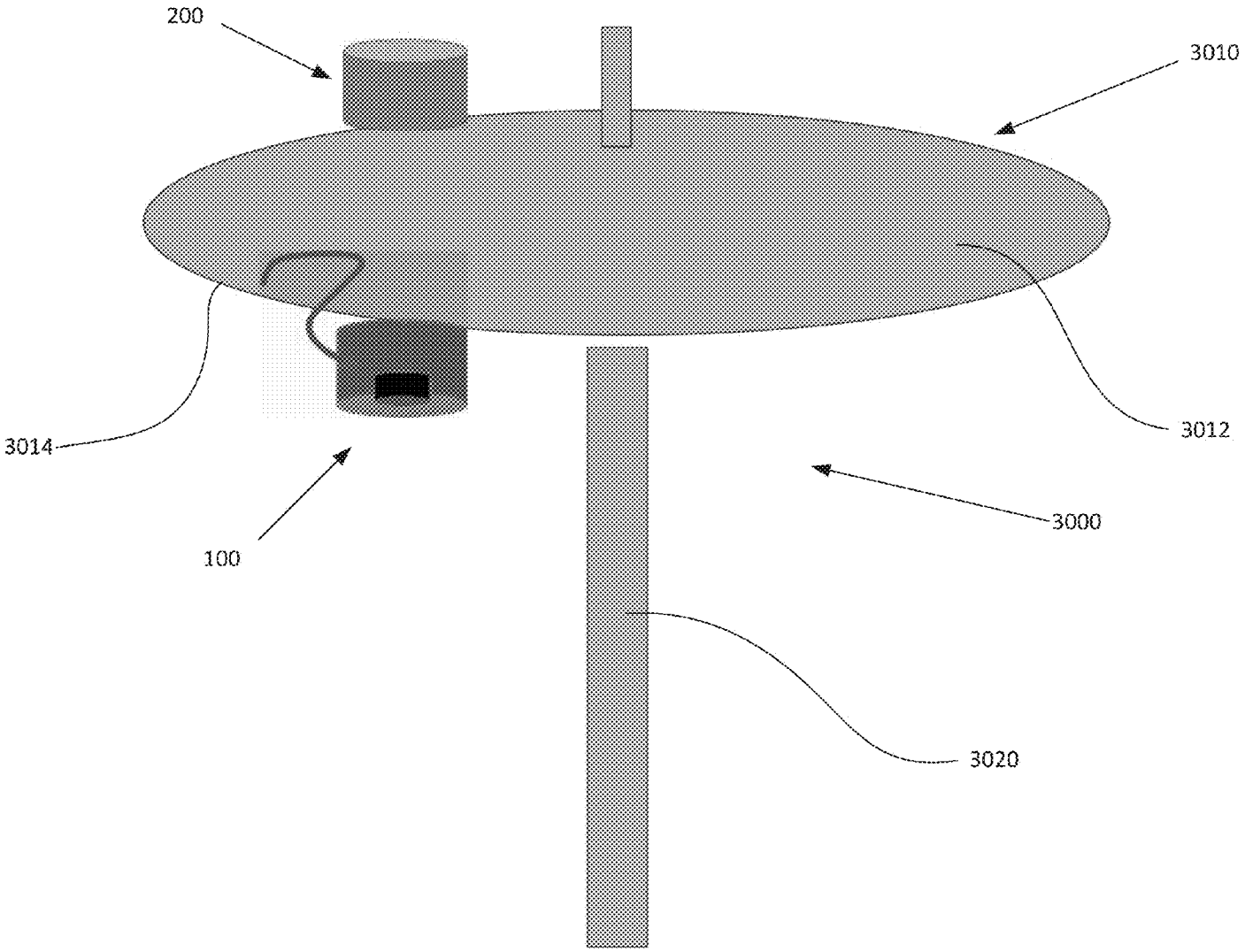
FIG. 30 provides a diagram of a trigger secured to a cymbal by a securing device according to the present invention.
Figures 31, 32, 33, 34, 35:
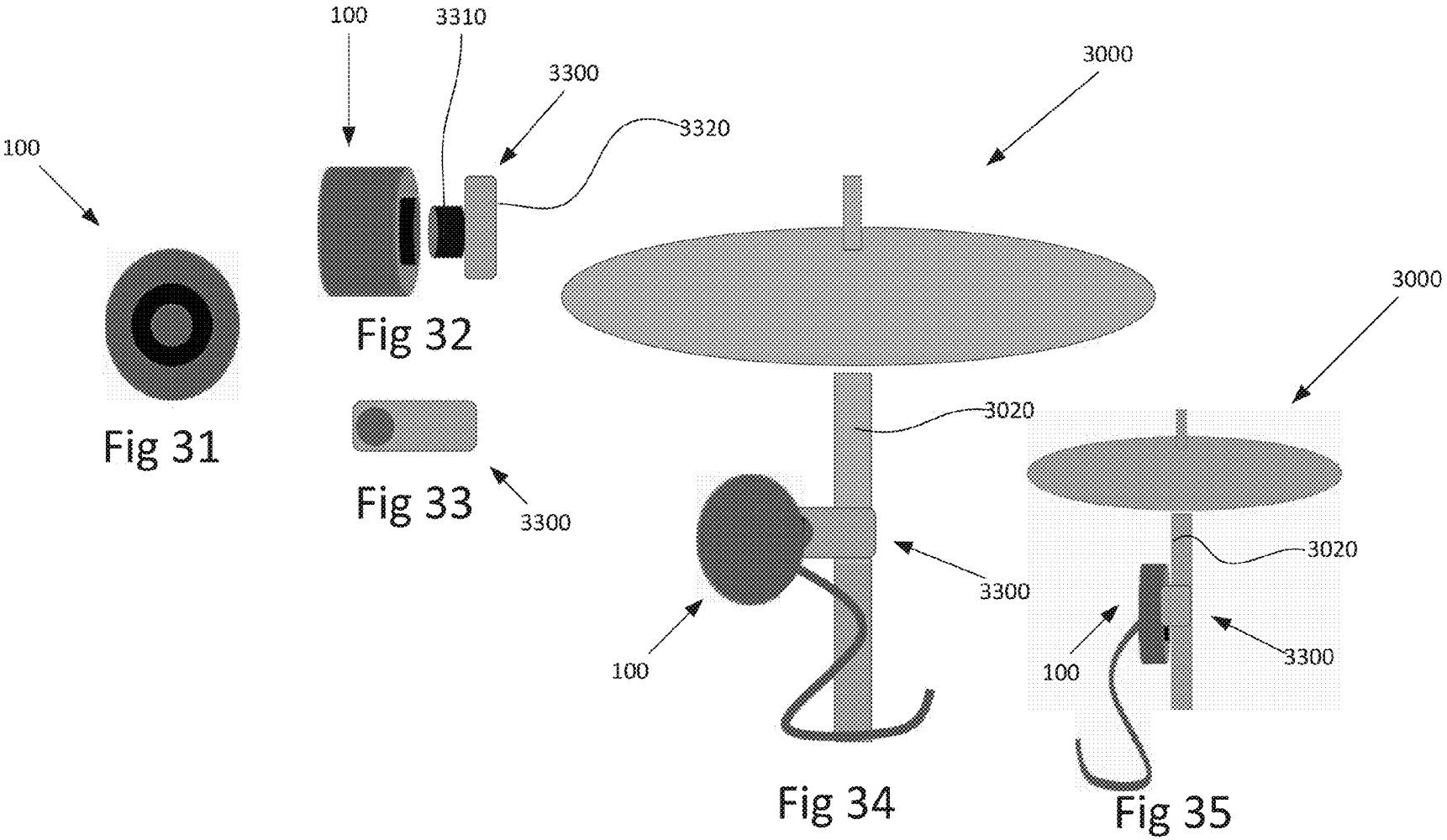
FIGS. 31, 32, 33, 34, and 35 provide diagrams of a trigger secured to a cymbal stand mount on a cymbal stand according to the present invention.
Figure 38:
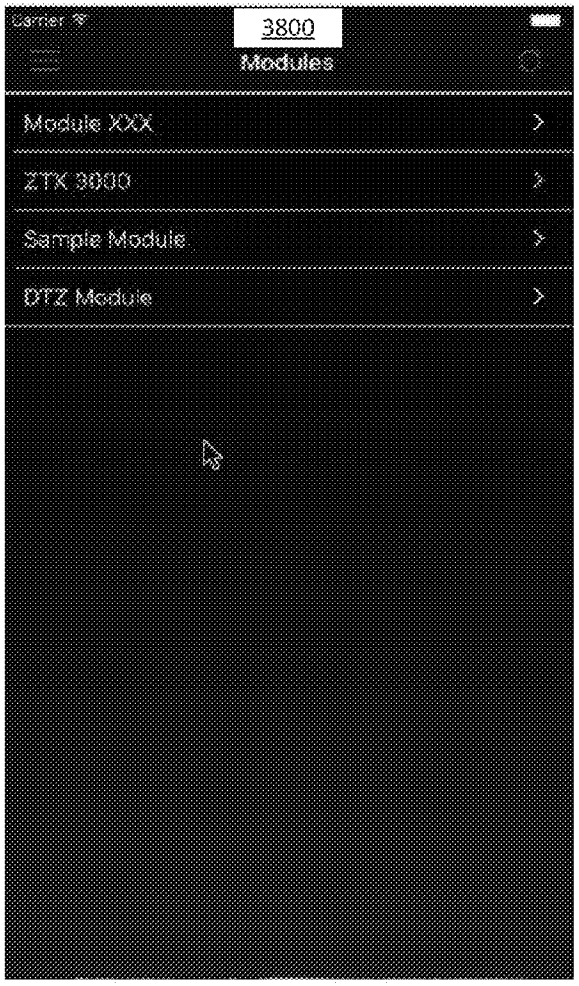
FIGS. 38, 39, 40, 41, 42, 43, and 44 provide exemplary screen-shots of an application for providing recommended drum module settings according to the present invention.
Figure 39:
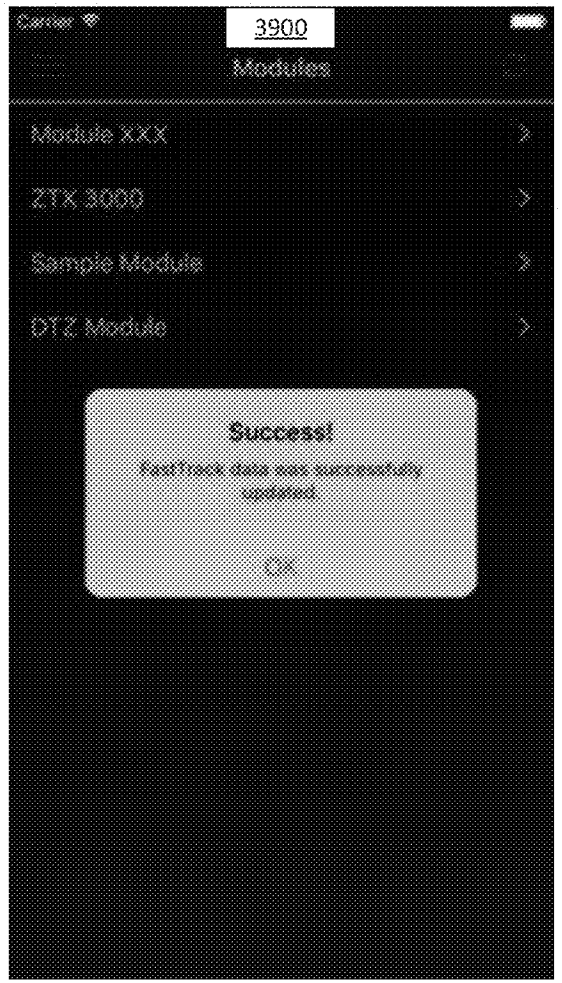
Figure 41:
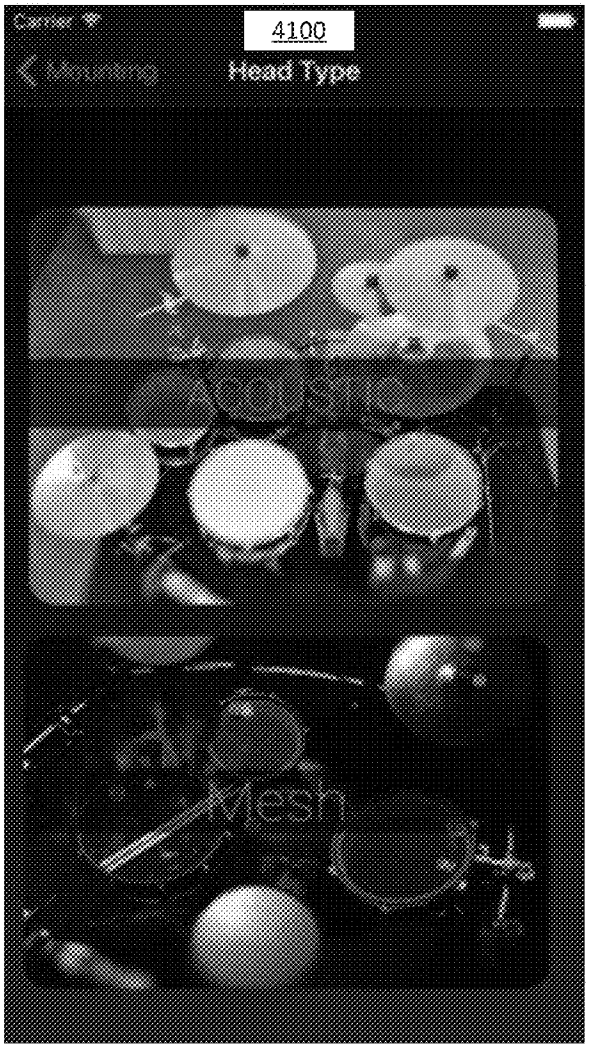
Figure 40:
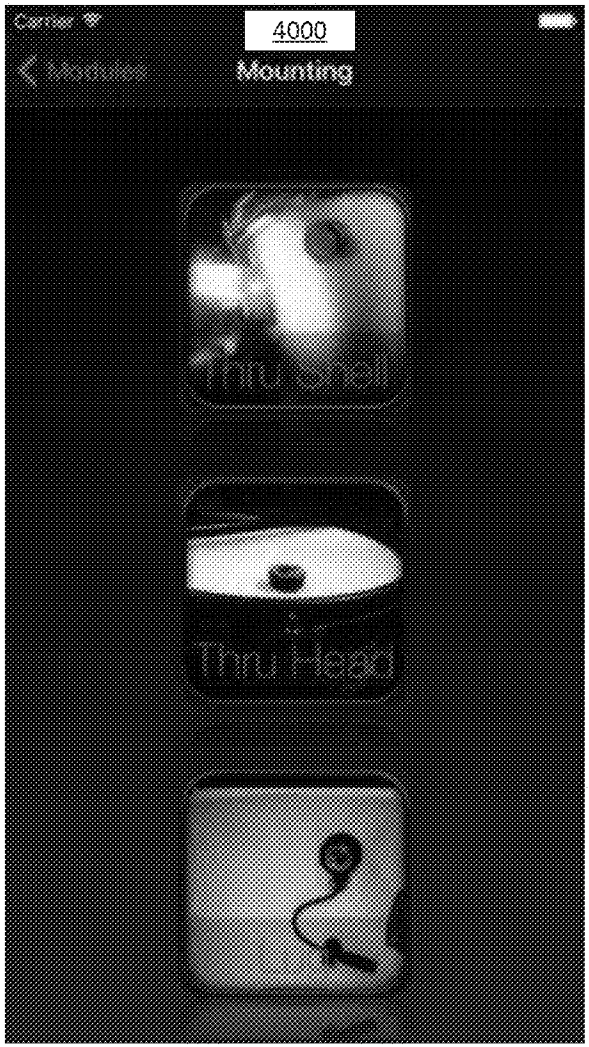
Figure 43:
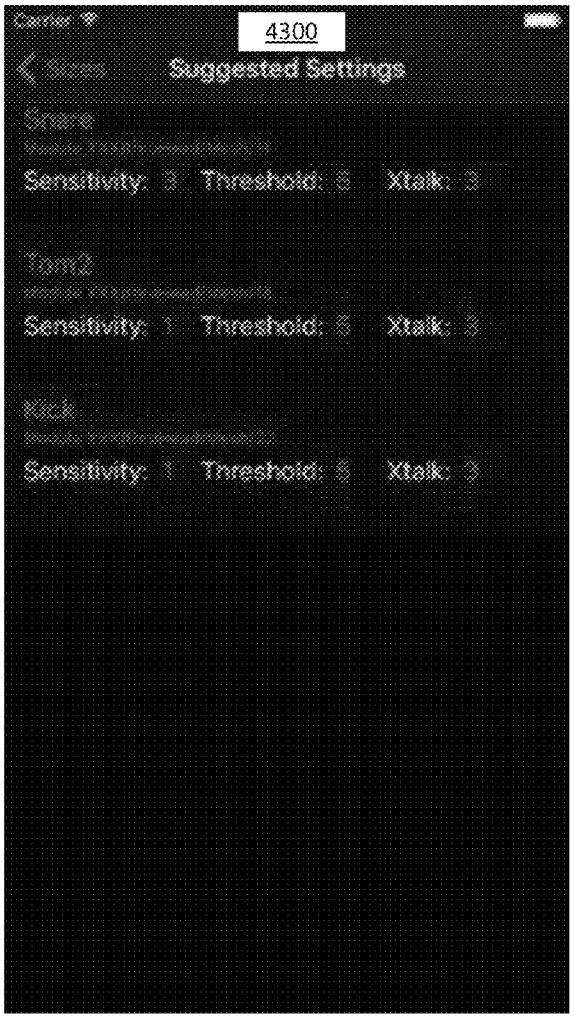
Figure 42:
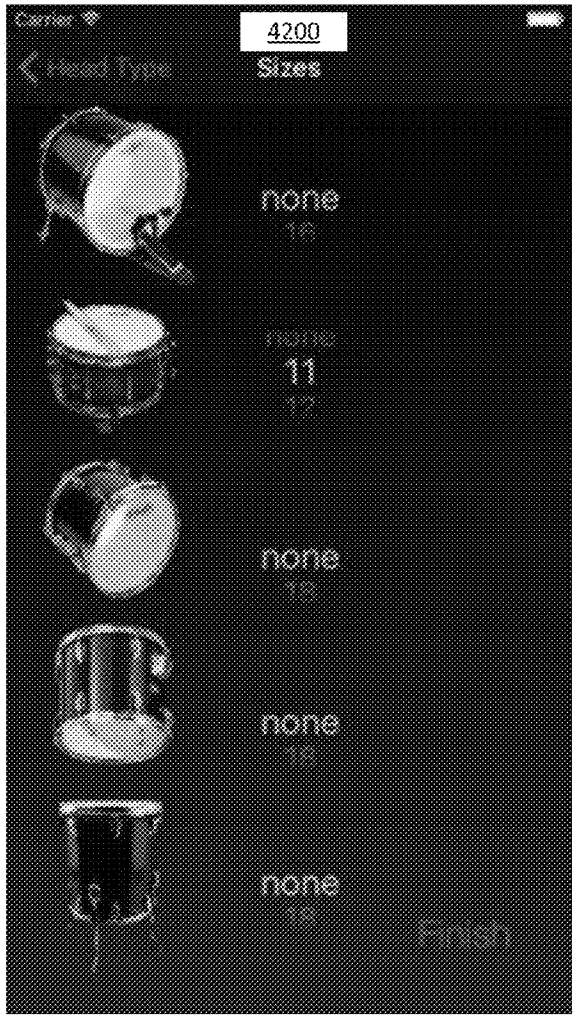
Figure 44:
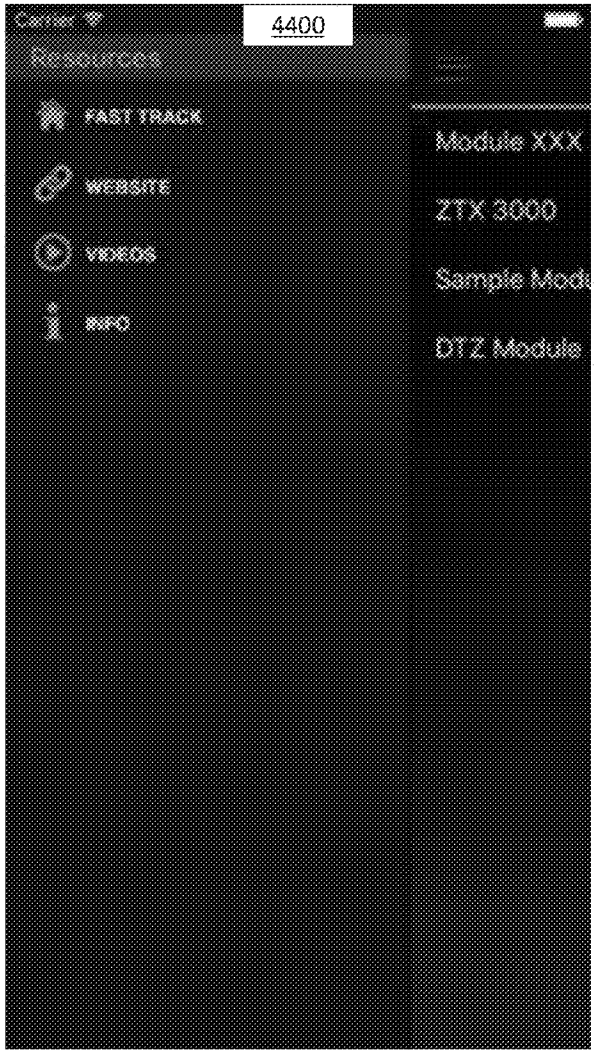

With reference now to FIG. 30, a diagram of a trigger 100 secured to a cymbal 3010 by a securing device 200 according to the present invention is provided. The cymbal 3010 is disposed at the top of a cymbal assembly 3000 including a cymbal stand 3020. The cymbal 3010 may be a metal cymbal or may be a plastic or rubber practice cymbal. The trigger 100 works with any cymbal 3010 material composition. The securing device 200 is positioned on the top 3012 of the cymbal 3010 and the trigger 100 is disposed on the bottom 3014 of the cymbal 3010 opposite the securing device 200. Magnets in one or both of the securing device 200 and trigger 100 magnetically and releaseably secure the trigger 100 to the cymbal 3010. More than one trigger 100 may be placed on the cymbal 3010 to enable a player to play different cymbal sounds such as a bell sound or a crash sound on the body of the cymbal 3010. The trigger 100 does not experience crosstalk interference and therefore has no problems operating with additional triggers 100 on the cymbal 3010 when properly tuned using a module such as the electronic module 300 shown in FIG. 2.

With reference now to FIGS. 31, 32, 33, 34, and 35, diagrams of a trigger 100 secured to a cymbal stand mount 3300 on a cymbal stand 3020 according to the present invention are provided. The cymbal stand mount 3300 may have one or more protrusions 3310 disposed on the body 3320 of the cymbal stand mount 3300 adapted to fit within the grommet 160 of the trigger 100. The protrusion 3310 may be comprised of a neodymium magnet or other ferromagnetic material such that the magnet 120 in the trigger 100 is magnetically attracted to the protrusion 3310. The cymbal stand mount 3300 may be placed anywhere on the cymbal stand 3020 of the cymbal assembly 3000. The position of the cymbal stand mount 3300 may be adjusted to provide optimal performance of the trigger 100.

With reference now to FIGS. 36, 36A, and 36B and 37, line drawings of a trigger 100 disposed on a guitar 3600 and a violin 3700, respectively are provided. When used with an acoustic instrument as shown in FIGS. 36, 36A, and 36B and 37, the trigger 100 may be referred to as a microphone or musical instrument pickup. However, the design of the trigger 100 will be similar if not identical to the design of the trigger 100 when used with drums or other percussion instruments. The trigger 100 may be placed on a guitar 3600, violin 3700, or any other acoustic instrument that produces mechanical vibrations that may be picked up by the piezoelectric transducer 140 and transmitted as an electrical signal. The trigger 100 may be secured by the securing device 200 and the tone is captured through the body of the instrument 3600 or 3700. The optimal placement of the trigger 100 depends on the specific musical instrument on which the trigger 100 is placed. The trigger 100 is not limited to these applications and may be used in a wide variety of acoustic instruments. The trigger 100 may also be used to trigger other functions such as computer operations, inputs for other devices, light switching, etc., and may function with any device that it may be operatively connected to.

With reference now to FIGS. 38, 39, 40, 41, 42, 43, and 44, exemplary screen-shots of an application, which may be the FastTrack application from MagnaTrack, for providing recommended drum module settings according to the present invention are provided. The application shown in FIGS. 38-44 provides a user with a set of suggested settings for configuring a drum module such as the module 300 shown in FIG. 2. In the screen 3800 a user selects a module from a list of modules stored in the application. The screen 3900 shows a response screen for when a user updates the list of modules from a central server. The list of modules may be updated or expanded at any time any may be contributed to by other users of the application. Once a module has been selected on the screen 3800, a user then selects the method of attaching the trigger 100 used on the screen 4000 from, for example, drum head, shell, or lug attachment, and then on the screen 4100 the user selects the drum head type from, for example, mesh or acoustic. On the screen 4200 the user selects the drum type and drum head size, e.g. selects a bass drum, snare drum, kick drum, tom, etc. The user may select more than one drum type and drum head size on the screen 4200 and may also select a set of cymbal types and sizes. At screen 4300 the user is presented with a set of suggested settings to use for the selected module and drum types. The resources screen 4400 enables a user to navigate to the application home page, an associated web site, a set of tutorial or help videos, or an info page.

Figure 52A:
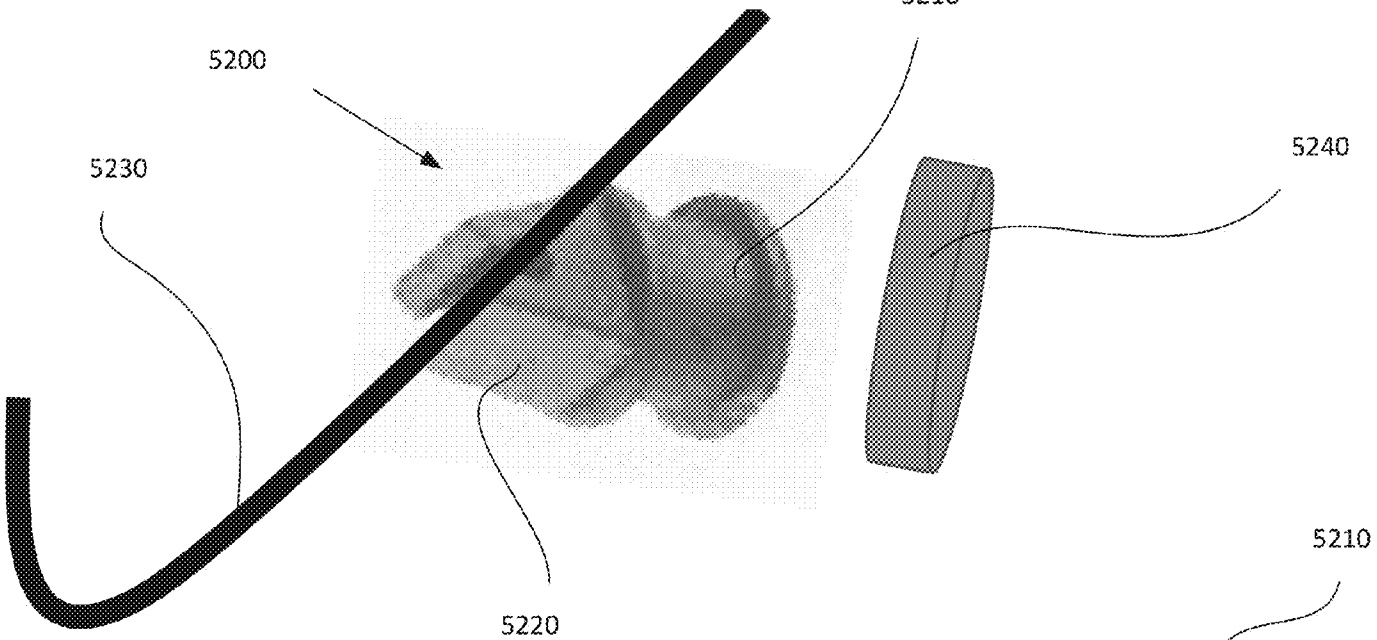
FIGS. 52A and 52B provide perspective and front diagrams of a lapel microphone using a magnetically attached piezoelectric transducer.
Figure 52B:
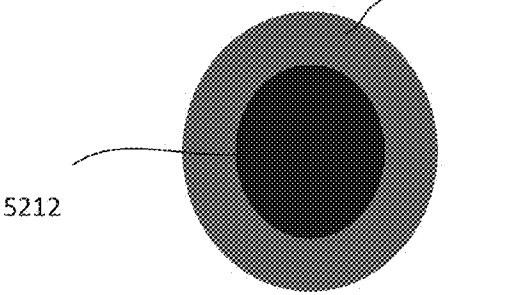

With respect to FIGS. 52A and 52 B, perspective and front views of a lapel microphone 5200 are provided. The same technology used in the trigger 100 may be employed in a lapel microphone 5200 attached to a shirt or other fabric. A clip 5220 secures the microphone wire 5230 to the lapel microphone 5200. A securing device 5240 comprising a magnet would be placed on the opposite side of the fabric relative to the microphone 5200. The body 5210 of the lapel microphone 5200 may house a magnet and piezoelectric transducer in a configuration similar to that shown in FIG. 1.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A method for causing an electronic module to perform a function based on a detected vibration from a percussion instrument, the method comprising:

releaseably securing a trigger to a percussion instrument, the trigger comprising:

a housing;

a magnet disposed and secured within the housing and adapted to removably secure the trigger to the percussion instrument;

a piezo-electric transducer having an electrical output and being disposed within the housing, the piezo-electric transducer being essentially electrically and physically isolated from the magnet and adapted to generate an electrical signal in response to a detected mechanical vibration associated with operation of the percussion instrument; and a plastic membrane disposed intermediate the piezo-electric transducer and a striking surface of the percussion instrument;

placing the trigger electrical output in electrical communication with the electronic module;

generating a trigger output signal in response to a detected mechanical vibration associated with operation of the percussion instrument;

sending the trigger electrical output signal to the electronic module;

receiving at the electronic module the trigger electrical output signal;

determining, at the electronic module, which function from a set of functions to execute on the received trigger electrical output signal; and executing, by the electronic module, the determined function.

2. The method of claim 1 wherein the trigger further comprises a second magnet, the second magnet disposed opposite the first magnet with the striking surface of the percussion instrument disposed between the first and second magnets, and wherein the piezo-electric transducer is disposed intermediate the first magnet and the striking surface and in vibrational communication with the striking surface.

3. The method of claim 1 further comprising wherein the trigger electrical output signal has a range of 127 signal levels.

4. The method of claim 1 further comprising wherein the set of functions stored in the electronic module comprise a set of recorded or generated musical instrument sounds.

5. The method of claim 1 further comprising wherein the electronic module is a drum module comprising wherein the drum module comprises a set of input ports and wherein the determining is based on which input port from the set of input ports receives the trigger electrical output signal.

6. The method of claim 1 further comprising determining a configuration for the electronic module from a set of configurations stored in the electronic module.

7. The method of claim 6, wherein the determining a configuration of the electronic module comprises:

inputting in a software program on a computer a set of parameters, the set of parameters comprising: a trigger type; a trigger securing method; an instrument type; and an instrument configuration;

determining, by the software program based on the set of parameters, a set of suggested settings for the electronic module; and configuring the electronic module based on the set of suggested settings.

8. The method of claim 1 wherein a gap physically separates the piezo-electric transducer and the magnet to allow the piezo-electric transducer to freely vibrate in response to the detected mechanical vibration at the striking surface of the percussion instrument.

9. A trigger system for generating a signal for output to an electronic module for generating sound associated with a musical instrument, the signal derived from a vibration detected upon a user operating a percussion instrument, the trigger system comprising:

a trigger adapted to be removably mounted onto a percussion instrument and comprising:

a housing;

a magnet disposed and secured within the housing and adapted to removably secure the trigger to the percussion instrument;

a piezo-electric transducer having an electrical output and being disposed within the housing, the piezo-electric transducer being essentially electrically and physically isolated from the magnet and adapted to generate an electrical signal in response to a detected mechanical vibration associated with operation of the percussion instrument;

a plastic membrane disposed intermediate the piezo-electric transducer and a striking surface of the percussion instrument; and an electrical lead connected to the piezo-electric transducer electric output and in electrical communication with an input of an electronic module adapted to produce sounds representing musical instrument sounds based on the electrical signal.

10. The trigger system of claim 9 wherein the electrical lead passes through a pass-through opening of the housing and is supported by a strain relief mechanism to prevent undesired disconnection with the piezo-electric transducer electrical output.

11. The trigger system of claim 9 further comprising a second magnet, the second magnet disposed opposite the first magnet with the striking surface of the percussion instrument disposed between the first and second magnets, and wherein the piezo-electric transducer is disposed intermediate the first magnet and the striking surface and in vibrational communication with the striking surface.

12. The trigger system of claim 9 further comprising a supplemental restraint mechanism adapted to assist in holding the trigger in place once placed on a percussion instrument.

13. The trigger system of claim 12 wherein the supplemental restraint mechanism is one of the group comprising: adhesive, adhesive material, and an anchor arm attached to a non-striking surface of the percussion instrument.

14. A method for causing an electronic module to perform a function based on a detected vibration from a percussion instrument, the method comprising:

releaseably securing a trigger to a percussion instrument, the trigger comprising:

a housing;

a magnet disposed and secured within the housing and adapted to removably secure the trigger to the percussion instrument; and a piezo-electric transducer having an electrical output and being disposed within the housing, the piezoelectric transducer being essentially electrically and physically isolated from the magnet and adapted to generate an electrical signal in response to a detected mechanical vibration associated with operation of the percussion instrument;

wherein a gap physically separates the piezo-electric transducer and the magnet to allow the piezo-electric transducer to freely vibrate in response to the detected mechanical vibration at the striking surface of the percussion instrument;

placing the trigger electrical output in electrical communication with the electronic module;

generating a trigger output signal in response to a detected mechanical vibration associated with operation of the percussion instrument;

sending the trigger electrical output signal to the electronic module;

receiving at the electronic module the trigger electrical output signal;

determining, at the electronic module, which function from a set of functions to execute on the received trigger electrical output signal; and executing, by the electronic module, the determined function.

15. The method of claim 14, further comprising wherein the trigger electrical output signal has a range of 127 signal levels.

16. The method of claim 14, further comprising:

wherein the set of functions stored in the electronic module comprise a set of recorded or generated musical instrument sounds; and wherein the electronic module is a drum module comprising wherein the drum module comprises a set of input ports and wherein the determining is based on which input port from the set of input ports receives the trigger electrical output signal.

17. The method of claim 14, further comprising determining a configuration for the electronic module from a set of configurations stored in the electronic module.

18. The method of claim 17, wherein the determining a configuration of the electronic module comprises:

inputting in a software program on a computer a set of parameters, the set of parameters comprising: a trigger type; a trigger securing method; an instrument type; and an instrument configuration;

determining, by the software program based on the set of parameters, a set of suggested settings for the electronic module; and configuring the electronic module based on the set of suggested settings.

19. The method of claim 14, wherein the trigger further comprises a plastic membrane disposed intermediate the piezo-electric transducer and a striking surface of the percussion instrument.

* * * * *